US011183775B2

(12) United States Patent
Li et al.

(10) Patent No.: US 11,183,775 B2
(45) Date of Patent: Nov. 23, 2021

(54) BASE STATION ANTENNAS HAVING PARASITIC ASSEMBLIES FOR IMPROVING CROSS-POLARIZATION DISCRIMINATION PERFORMANCE

(71) Applicant: CommScope Technologies LLC, Hickory, NC (US)

(72) Inventors: Yunzhe Li, Suzhou (CN); YueMin Li, Suzhou (CN); Peter J. Bisiules, La Grange Park, IL (US); Xiaohua Tian, Suzhou (CN); Junfeng Yu, Suzhou (CN); Dongmin Wang, Suzhou (CN); Xiaoan Fu, Suzhou (CN); Haidan Tang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 30 days.

(21) Appl. No.: 16/823,450

(22) Filed: Mar. 19, 2020

(65) Prior Publication Data

US 2020/0303836 A1 Sep. 24, 2020

Related U.S. Application Data

(60) Provisional application No. 62/821,622, filed on Mar. 21, 2019.

(51) Int. Cl.
*H01Q 21/24* (2006.01)
*H01Q 1/24* (2006.01)
(Continued)

(52) U.S. Cl.
CPC ..... *H01Q 21/245* (2013.01); *H01Q 1/24* (2013.01); *H01Q 1/246* (2013.01); *H01Q 21/24* (2013.01); *H01Q 21/26* (2013.01); *H01Q 1/521* (2013.01)

(58) Field of Classification Search
CPC ..... H01Q 21/245; H01Q 1/246; H01Q 21/26; H01Q 1/521; H01Q 21/24; H01Q 1/24
(Continued)

(56) References Cited

U.S. PATENT DOCUMENTS 3,681,770 A * 8/1972 Alford ..... H01Q 1/521 343/815
4,499,474 A 2/1985 Muhs, Jr. et al.
(Continued)

FOREIGN PATENT DOCUMENTS

CN 101662068 3/2010
EP 0895303 A1 2/1999
(Continued)

OTHER PUBLICATIONS

International Search Report and the Written Opinion of the International Searching Authority corresponding to International Patent Application No. PCT/US2020/022962 (20 pages) (dated Aug. 19, 2020).

*Primary Examiner* — Hai V Tran
(74) *Attorney, Agent, or Firm* — Myers Bigel, P.A.

(57) ABSTRACT

Base station antennas include a reflector, a first array of cross-polarized radiating elements that are mounted to extend forwardly from the reflector, and a parasitic assembly. The parasitic assembly includes a base that is mounted on the reflector, a horizontal component shaping element, and a forwardly projecting member that projects forwardly from the base that is coupled between the base and the horizontal component shaping element. The horizontal component shaping element may extend substantially parallel to a plane defined by the reflector and may include a proximate side that is directly connected to the forwardly projecting member and a distal side that is opposite the proximate side.
(Continued)

The distal side of is only electrically connected to the reflector through the proximate side.

22 Claims, 13 Drawing Sheets

(51) Int. Cl.
*H01Q 21/26* (2006.01)
*H01Q 1/52* (2006.01)

(58) Field of Classification Search
USPC ..... 343/878
See application file for complete search history.

(56) References Cited

U.S. PATENT DOCUMENTS 5,548,813 A 8/1996 Charas et al.
5,955,994 A 9/1999 Staker et al.
6,025,812 A 2/2000 Gabriel et al.
6,028,563 A 2/2000 Higgins
6,195,063 B1 * 2/2001 Gabriel ..... H01Q 19/108 343/797
6,734,829 B1 5/2004 Goettl
10,224,639 B2 3/2019 Chainon et al.
10,431,877 B2 * 10/2019 Varnoosfaderani .... H01Q 1/246
10,833,401 B2 * 11/2020 Thotahewa ..... H01Q 1/521
2001/0054983 A1 12/2001 Judd et al.
2002/0070902 A1 * 6/2002 Johnson ..... H01Q 1/243 343/702
2002/0101388 A1 8/2002 Ippolito
2002/0140618 A1 10/2002 Plet et al.
2003/0193446 A1 10/2003 Chen
2005/0073465 A1 4/2005 Olson
2005/0179610 A1 * 8/2005 Le ..... H01Q 9/0414 343/797
2006/0038736 A1 2/2006 Hui et al.
2006/0114168 A1 * 6/2006 Gotti ..... H01Q 1/246 343/797
2006/0259024 A1 * 11/2006 Turovskiy ..... A61B 18/1815 606/33
2007/0008236 A1 1/2007 Tillery et al.
2008/0094286 A1 4/2008 Le Bayon et al.
2009/0096700 A1 * 4/2009 Chair ..... H01Q 21/26 343/797
2010/0013729 A1 1/2010 Harel et al.
2010/0265150 A1 10/2010 Arvidsson et al.
2011/0006949 A1 1/2011 Webb
2011/0181482 A1 7/2011 Adams et al.
2012/0013519 A1 1/2012 Håkansson et al.
2012/0062440 A1 3/2012 Tasaki et al.
2012/0115548 A1 5/2012 Shimizu et al.
2012/0280874 A1 11/2012 Kim et al.
2013/0162496 A1 6/2013 Wakabayashi
2013/0293425 A1 11/2013 Zhu et al.
2014/0043195 A1 2/2014 Ho et al.
2014/0085158 A1 3/2014 Wong et al.
2014/0139387 A1 * 5/2014 Jones ..... H01Q 19/30 343/794
2014/0152523 A1 6/2014 Wu et al.
2014/0191042 A1 7/2014 Brown et al.
2014/0203960 A1 7/2014 Huang et al.
2014/0242930 A1 8/2014 Barker et al.
2014/0266922 A1 9/2014 Jin et al.
2014/0266957 A1 9/2014 Inoue
2014/0375502 A1 12/2014 Foo
2015/0214613 A1 7/2015 Bäckman et al.
2016/0254594 A1 * 9/2016 Jones ..... H01Q 5/42 343/797
2017/0310009 A1 * 10/2017 Isik ..... H01Q 21/26
2018/0034164 A1 * 2/2018 Jang ..... H01Q 9/04
2018/0248257 A1 * 8/2018 Thotahewa ..... H01Q 1/246
2018/0331419 A1 * 11/2018 Varnoosfaderani ..... H01Q 21/0006

FOREIGN PATENT DOCUMENTS

WO 2010/018896 2/2010
WO 2015/101138 7/2015
WO 2017/091307 6/2017

* cited by examiner

BASE STATION ANTENNAS HAVING PARASITIC ASSEMBLIES FOR IMPROVING CROSS-POLARIZATION DISCRIMINATION PERFORMANCE

CROSS-REFERENCE TO RELATED APPLICATION

The present application claims priority under 35 U.S.C. § 119 to U.S. Provisional Patent Application Ser. No. 62/821,622, filed Mar. 21, 2019, the entire content of which is incorporated herein by reference.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells" which are served by respective base stations. Each base station may include one or more antennas that are configured to provide two-way radio frequency ("RF") communications with mobile subscribers that are within the cell served by the base station. In many cases, each cell is divided into "sectors." In one common configuration, a hexagonally shaped cell is divided into three 1200 sectors in the azimuth plane, and each sector is served by one or more base station antennas that have an azimuth Half Power Beamwidth (HPBW) of about 65°. Typically, the base station antennas are mounted on a tower, with the radiation patterns (also referred to herein as "antenna beams") that are generated by the base station antennas directed outwardly. Base station antennas are often implemented as linear or planar phased arrays of radiating elements.

In order to accommodate the increasing volume of cellular communications, cellular operators have added cellular service in a variety of new frequency bands. Cellular operators typically want to limit the number of base station antennas that are deployed at a given base station, and hence so-called multi-band base station antennas are now routinely deployed in order to support cellular service in the new frequency bands without increasing the number of base station antennas. In some cases, a multi-band antenna may include a single linear array of wideband radiating elements that is used to support service in two or more different frequency bands. In other cases, a multi-band antenna may include two or more different arrays of radiating elements that operate in different frequency bands. Unfortunately, however, it may be more difficult to meet performance specifications when wideband radiating elements are used as ensuring performance over larger frequency ranges may be difficult, and performance specifications may be more difficult to meet in antennas that include multiple arrays of radiating elements because the arrays may interact with each other in unintended ways.

SUMMARY

Pursuant to embodiments of the present invention, base station antennas are provided that include a reflector that defines a substantially vertical plane and a plurality of cross-polarized radiating elements that form a first array of radiating elements. The cross-polarized radiating elements are mounted to extend forwardly from the reflector, and each cross-polarized radiating element including a −45° dipole radiator and a +45° dipole radiator. These base station antenna further include a parasitic assembly that is mounted to extend forwardly from the reflector, the parasitic assembly including a base that is mounted on the reflector, a horizontal component shaping element, and a forwardly projecting member that projects forwardly from the base that is coupled between the base and the horizontal component shaping element. The horizontal component shaping element is slanted less than 45° from the substantially vertical plane defined by the reflector and includes a proximate side that is directly connected to the forwardly projecting member and a distal side that is opposite the proximate side. Additionally, the distal side of the horizontal component shaping element is only electrically connected to the reflector through the proximate side of the horizontal component shaping element.

In some embodiments, the horizontal component shaping element may be slanted less than 15° from the substantially vertical plane defined by the reflector.

In some embodiments, the parasitic assembly may be mounted directly adjacent a first of the cross-polarized radiating elements and may be between the first of the cross-polarized radiating elements and a transverse edge of the reflector.

In some embodiments, the parasitic assembly may be one of a plurality of parasitic assemblies, and the parasitic assemblies may be mounted adjacent the respective cross-polarized radiating elements in the first array of radiating elements.

In some embodiments, an extent to which the forwardly projecting member projects forwardly may be selected so that the horizontal component shaping element will primarily alter the cross-polarization discrimination performance of the first array in a selected sub-band of the operating frequency range of the first array of radiating elements.

In some embodiments, the horizontal component shaping element may include at least one slot. In some embodiments, a longitudinal axis of the slot may extend substantially vertically.

In some embodiments, the horizontal component shaping element may be positioned a first distance forwardly of the reflector, and the bottom edge the −45° dipole radiator is positioned as second distance forwardly of the reflector, wherein the second distance is greater than the first distance.

In some embodiments, the first array of radiating elements may be configured to form a first antenna beam having a −45° polarization and a second antenna beam having a +45° polarization that each provide coverage to a predefined sector, and the parasitic assembly may be configured to alter the horizontal components of the portions of the first and second antenna beams that are within the sector at least twice as much as the respective vertical components of the portions of the first and second antenna beam that are within the sector.

In some embodiments, the parasitic assembly may be capacitively coupled to the reflector.

In some embodiments, the forwardly projecting member may include an opening.

In some embodiments, the parasitic assembly may comprise a monolithic assembly formed from a piece of sheet metal.

In some embodiments, the horizontal component shaping element may extend substantially parallel to the reflector.

Pursuant to further embodiments of the present invention, base station antennas are provided that include a reflector that defines a substantially vertical plane, a plurality of cross-polarized radiating elements that form a first array of radiating elements, the cross-polarized radiating elements mounted to extend forwardly from the reflector, and each cross-polarized radiating element including a −45° dipole radiator and a +45° dipole radiator, and a parasitic assembly mounted to extend forwardly from the reflector, the parasitic assembly including a base that is mounted on the reflector, a horizontal component shaping element, and a forwardly projecting member that projects forwardly from the base that is coupled between the base and the horizontal component shaping element. The horizontal component shaping element is slanted less than 45° from the substantially vertical plane defined by the reflector, and the parasitic assembly is mounted directly adjacent a first of the cross-polarized radiating elements and is between the first of the cross-polarized radiating elements and a transverse edge of the reflector.

Pursuant to further embodiments of the present invention, base station antennas are provided that include a reflector that defines a substantially vertical plane, a plurality of cross-polarized radiating elements that form a first array of radiating elements, the cross-polarized radiating elements mounted to extend forwardly from the reflector, and each cross-polarized radiating element including a −45° dipole radiator and a +45° dipole radiator, a first parasitic assembly mounted forwardly from the reflector on a first side of a first of the cross-polarized radiating elements, and a second parasitic assembly mounted forwardly from the reflector on a second side of the first of the cross-polarized radiating elements. The first and second parasitic assemblies each include a base that is mounted on the reflector, a horizontal component shaping element that extends substantially parallel to the reflector, and a forwardly projecting member that projects forwardly from the base that is coupled between the base and the horizontal component shaping element.

In some embodiments, the horizontal component shaping element may be slanted less than 20° from the substantially vertical plane defined by the reflector.

In some embodiments, the horizontal component shaping element may extend substantially parallel to the reflector.

In some embodiments, the parasitic assembly may comprise one of a plurality of parasitic assemblies, and the parasitic assemblies may be mounted between the first array of radiating elements and the transverse edge of the reflector.

In some embodiments, the horizontal component shaping element may include at least one vertically-extending slot.

In some embodiments, the first array of radiating elements may be configured to form a first antenna beam having a −45° polarization and a second antenna beam having a +45° polarization that each provide coverage to a predefined sector, and the parasitic assembly may be configured to alter the horizontal components of the portions of the first and second antenna beams that are within the sector at least twice as much as the respective vertical components of the portions of the first and second antenna beam that are within the sector.

In some embodiments, the first array of radiating elements may comprise a column of radiating elements that extend along a first axis, and the first parasitic assembly may be a first of a plurality of parasitic assemblies that comprise a column of parasitic assemblies that extends along a second axis that is substantially parallel to the first axis.

In some embodiments, the horizontal component shaping element may be slanted less than 20° from the substantially vertical plane defined by the reflector.

In some embodiments, the horizontal component shaping element of the first parasitic assembly may include at least one slot.

In some embodiments, an extent to which the forwardly projecting member of the first parasitic assembly projects forwardly may be selected so that the horizontal component shaping element of the first parasitic assembly will primarily alter the cross-polarization discrimination performance of the first array in a selected sub-band of the operating frequency range of the first array of radiating elements.

In some embodiments, the first array of radiating elements may be configured to form a first antenna beam having a −45° polarization and a second antenna beam having a +45° polarization that each provide coverage to a predefined sector, and the parasitic assembly may be configured to alter the horizontal components of the portions of the first and second antenna beams that are within the sector at least twice as much as the respective vertical components of the portions of the first and second antenna beam that are within the sector.

In some embodiments, the parasitic assembly may be capacitively coupled to the reflector, and the parasitic assembly may comprise a monolithic assembly formed from a piece of sheet metal.

Pursuant to yet additional embodiments of the present invention, base station antennas are provided that include a reflector that defines a substantially vertical plane and a fence structure mounted to extend forwardly from the reflector. The fence structure includes a base that is mounted on the reflector and a forwardly projecting member that projects forwardly from the base. A dielectric coating is disposed between the base of the fence structure and the reflector.

In some embodiments, the dielectric coating may be sprayed onto the rear surface of the base of the fence structure facing the reflector.

In some embodiments, the dielectric coating may be made of Teflon or other dielectric materials suitable for spraying.

In some embodiments, the fence structure may comprise a parasitic assembly including a horizontal component shaping element that is coupled to the forwardly projecting member.

In some embodiments, the fence structure may be disposed between two arrays of radiating elements on the reflector.

DETAILED DESCRIPTION

Figure 1:
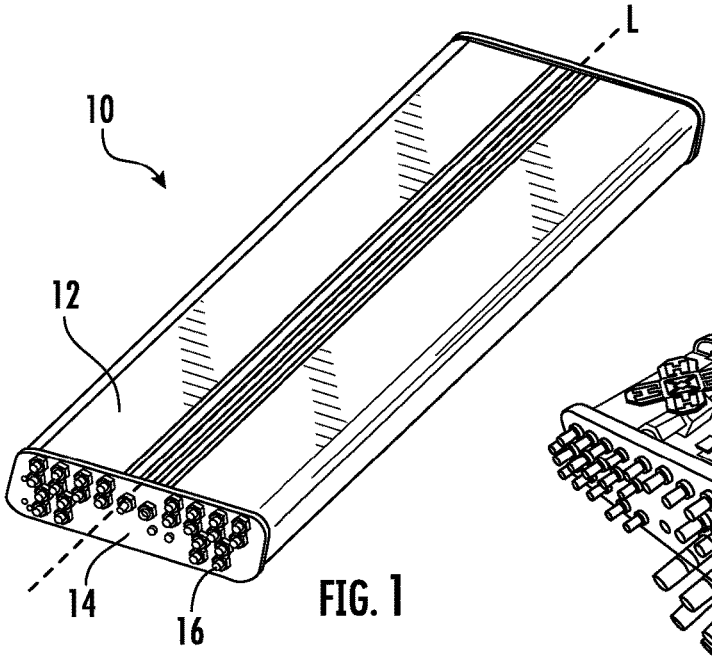
FIG. 1 is a perspective view of a base station antenna.

One important performance parameter in a base station antenna that includes arrays of cross-polarized radiating elements is the cross-polarization discrimination performance of the arrays. Generally speaking, in transmit mode, cross-polarization discrimination is a measure of the extent to which a signal is transmitted in the orthogonal polarization to the intended polarization, and in the receive mode, is a measure of the extent to which the received signal maintains the polarization purity of the incident signal. For example, when an RF signal having a perfect vertical linear polarization is incident on a vertical dipole radiator, electrical and mechanical imperfections in the antenna (e.g., in the dipole radiator, the underlying reflector, adjacent radiating elements) will introduce a small amount of ellipticity to the polarization of the signal (i.e., the polarization will change from a straight line to a narrow, imperfect ellipse) because the imperfections introduce some horizontal components into the received signal. The ratio of the horizontal to vertical components is one measure of the cross polarization discrimination performance of an array of radiating elements. The cross polarization performance of an array of radiating elements of a base station antenna is of concern because the portion of the signal that is converted from the intended polarization into the orthogonal polarization is lost signal energy with respect to the transmitted and received signals, and also typically represents an interfering signal for the dipole radiators of the cross-polarized radiating elements at the orthogonal polarization.

The cross polarization performance of an array may depend on a variety of factors, including the type of dipole radiators included in the radiating elements and the environment surrounding the radiating elements such as the size of the underlying reflector, nearby radiating elements that operate in different frequency bands, the radome, and various other features of the base station antenna. Moreover, the cross polarization performance of an array also varies with frequency, with any electronic downtilt applied to the array, and as a function of the pointing direction (from boresight) of the antenna beam formed by the linear array.

Most modern base station antennas that employ cross-polarized dipole radiating elements use radiating elements that have slant −45° and slant +45° dipole radiators. The antenna beam generated by a slant −45° (or +45°) dipole radiator (or an array of such dipole radiators) can be viewed as having a horizontally polarized component and a vertically polarized component. For ideal cross-polarization discrimination performance, the horizontal component and the vertical component should have the same magnitude at all different polarizations. Unfortunately, however, in practice the characteristics of the antenna beam may stray far from the desired ideal performance.

Pursuant to embodiments of the present invention, parasitic assemblies for base station antennas are provided (along with base station antennas including such parasitic assemblies) that are designed to primarily effect the horizontal component of an antenna beam while only having a relatively small effect on the vertical component of the antenna beam. The horizontal and vertical components of an antenna beam refer to the respective components of the antenna beam along respective horizontal and vertical directions. The parasitic assemblies according to embodiments of the present invention may be used, for example, to shape the horizontal component of an antenna beam formed by an array of one or more radiating elements while having only limited impact on the vertical component. These parasitic assemblies may be used in cases where a cross-polarization discrimination issue is based primarily (or solely) on the horizontal component of the antenna beam formed by a dipole radiator of a slant −45°/+45° cross-polarized radiating element.

The parasitic assemblies according to some embodiments of the present invention include a base that is mounted on the reflector of a base station antenna, a forwardly projecting member and a horizontal component shaping element that extends from the forwardly projecting element. The horizontal component shaping element is slanted less than 45° and, more preferably less than 15°, from the plane defined by the reflector. In some embodiments, the horizontal component shaping element may define a plane that is substantially parallel to the reflector, where "substantially parallel" means that the horizontal component shaping element is slanted less than 10° from the plane defined by the reflector.

In some embodiments, the horizontal component shaping element may include a proximate side that is directly connected to the forwardly projecting member and a distal side that is opposite the proximate side and that is only electrically connected to the reflector through the proximate side of the horizontal component shaping element. In some embodiments, the parasitic assembly comprises a monolithic assembly formed from a piece of sheet metal.

In some embodiments, the horizontal component shaping element may include one or more vertically-extending slots and/or the forwardly projecting member may include an opening. The parasitic assembly may be capacitively coupled to the reflector.

Pursuant to further embodiments of the present invention, base station antennas are provided that include a reflector and a first array of cross-polarized radiating elements that are mounted to extend forwardly from the reflector, and at least one parasitic assembly according to embodiments of the present invention that is mounted to extend forwardly from the reflector. In some embodiments, the parasitic assembly is mounted between a first of the cross-polarized radiating elements and a transverse edge of the reflector. In this position, the parasitic assembly may compensate for effects that the edge of the reflector may have on the cross-polarization discrimination performance of the first of the cross-polarized radiating elements. In other embodiments, a parasitic assembly may be mounted on each side of one or more of the cross-polarized radiating elements in the first array. In both cases, the parasitic assemblies may improve the cross-polarization discrimination performance of the first array.

In some embodiments, the parasitic assemblies may be configured to alter the horizontal components of certain portions of first and second antenna beams that are generated by the first array at least twice as much as the respective vertical components of these portions of the first and second antenna beam.

Embodiments of the present invention will now be described in further detail with reference to the attached figures. Before describing the parasitic assemblies according to embodiments of the present invention, an example base station antenna in which the parasitic assemblies according to embodiments of the present invention may be used will be described with reference to FIGS. 1-4 to provide context to the present disclosure.

Figure 2:
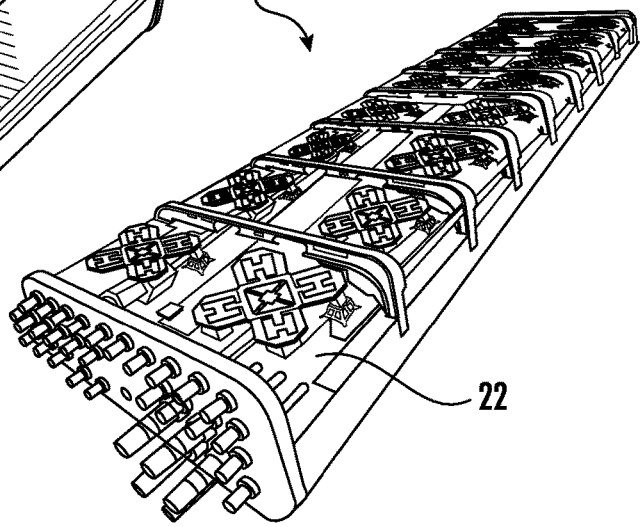
FIG. 2 is a front perspective view of the antenna assembly of the base station antenna of FIG. 1.
Figure 3:
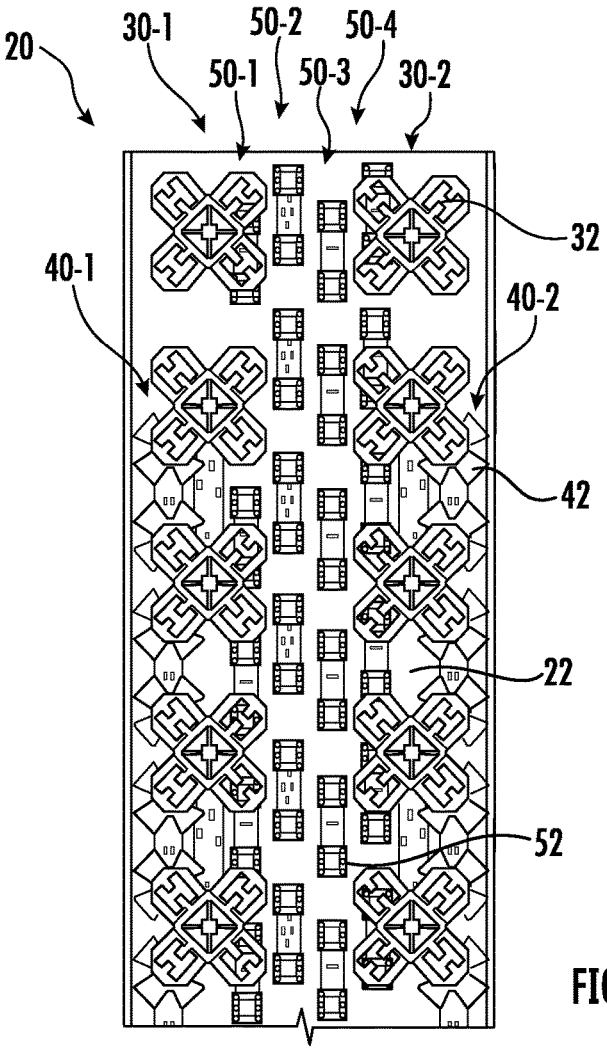
FIG. 3 is a schematic front view of an antenna assembly of the base station antenna of FIG. 1.

FIGS. 1-3 illustrate an example base station antenna 10 in which the parasitic assemblies according to embodiments of the present invention may be used. In the description that follows, the antenna 10 will be described using terms that assume that the antenna 10 is mounted for use with the longitudinal axis L of the antenna 10 extending along a vertical axis and the front surface of the antenna 10 pointing toward the coverage area for the antenna 10.

Referring to FIG. 1, the base station antenna 10 is an elongated structure that extends along a longitudinal axis L. The antenna 10 includes a radome 12 and a bottom end cap 14 which includes a plurality of connectors 16 mounted therein. One or more mounting brackets (not visible) may be provided on the rear side of the antenna 10 which may be used to mount the antenna 10 onto an antenna mount of an antenna tower. The radome 12 and bottom end cap 14 may form an external housing for the antenna 10. An antenna assembly 20 is contained within the housing (FIG. 2).

FIGS. 2 and 3 are a perspective view and a schematic front view, respectively, of the antenna assembly 20 of base station antenna 10. As shown in FIGS. 2-3, the antenna assembly 20 includes a reflector 22 that comprises a generally flat metallic surface that has a longitudinal axis that may extend parallel to the longitudinal axis L of the antenna 10. The reflector 22 may serve as both a structural component for the antenna assembly 20 and as a ground plane for the radiating elements mounted thereon.

As shown in FIGS. 2-3, the antenna assembly 20 includes respective pluralities of dual-polarized low-band radiating elements 32, mid-band radiating elements 42 and high-band radiating elements 52 that extend forwardly from the reflector 22. The low-band radiating elements 32 are mounted in two columns to form two linear arrays 30-1, 30-2 of low-band radiating elements 32. It should be noted that herein like elements may be referred to individually by their full reference numeral (e.g., linear array 30-2) and may be referred to collectively by the first part of their reference numeral (e.g., the linear arrays 30). The low-band radiating elements 32 may be configured to transmit and receive signals in a first frequency band such as, for example, the 617-960 MHz frequency range or a portion thereof.

The mid-band radiating elements 42 may likewise be mounted in two columns to form two linear arrays 40-1, 40-2 of mid-band radiating elements 42. The linear arrays 40-1, 40-2 of mid-band radiating elements 42 may extend along the respective side edges of the reflector 22. The mid-band radiating elements 42 may be configured to transmit and receive signals in a second frequency band such as, for example, the 1427-2690 MHz frequency range or a portion thereof.

The high-band radiating elements 52 are mounted in four columns in the center of antenna 10 to form four linear arrays 50-1 through 50-4 of high-band radiating elements 52. The high-band radiating elements 52 may be configured to transmit and receive signals in a third frequency band. In some embodiments, the third frequency band may comprise the 3300-4200 MHz frequency range or a portion thereof.

Each linear array 30, 40, 50 may be configured to provide service to a sector of a base station. For example, each linear array 30, 40, 50 may be configured to provide coverage to approximately 120° in the azimuth plane so that the base station antenna 10 may act as a sector antenna for a three-sector base station. All of the radiating elements 32, 42, 52 are implemented as slant −45°/+45° cross-polarized dipole radiating elements that have a first dipole radiator that can transmit and receive first RF signals at a −45° polarization and that have a second dipole radiator that can transmit and receive second RF signals at a +45° polarization.

Figure 4:
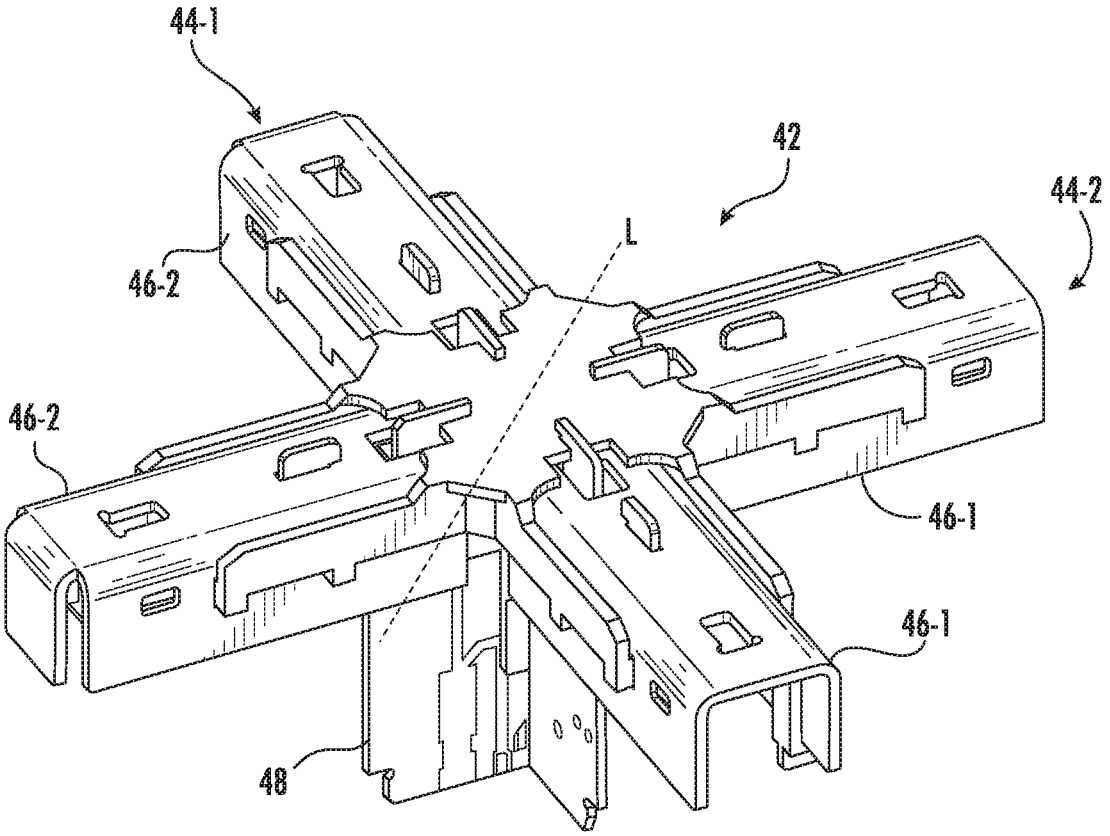
FIG. 4 is a perspective view of one of the mid-band radiating elements included in the base station antenna of FIG. 1.

FIG. 4 is a perspective view illustrating one specific design for the mid-band radiating elements 42 included in the base station antenna 10 of FIG. 1. As shown in FIG. 4, the mid-band radiating element 42 includes first and second dipoles radiators 44-1, 44-2 that are mounted on a feed stalk 48. The first dipole radiator 44-1 is positioned at an angle of −45 with respect to the longitudinal axis of the antenna 10, and the second dipole radiator 44-2 is positioned at an angle of +45 with respect to the longitudinal axis of the antenna 10. Each dipole radiator 44 includes first and second collinear dipole arms 46-1, 46-2.

Figure 5:
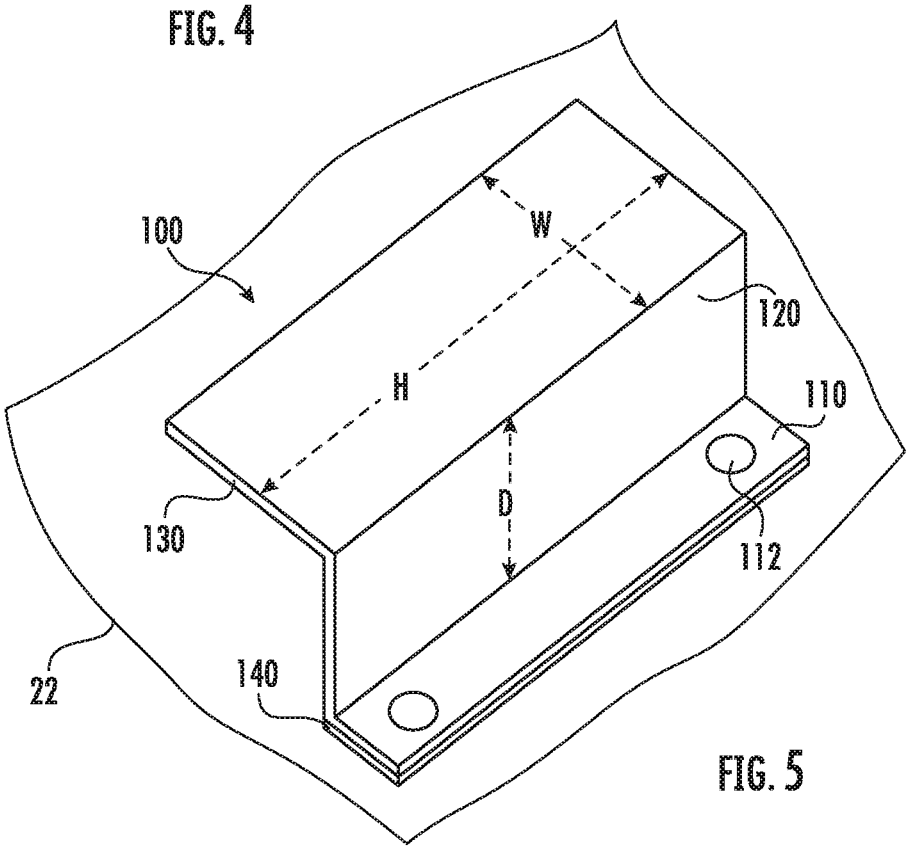
FIG. 5 is a perspective view of a parasitic assembly according to embodiments of the present invention.

FIG. 5 is a perspective view of a parasitic assembly 100 according to embodiments of the present invention. The parasitic assembly 100 includes a mounting base 110 that is configured to be mounted to a frame of an antenna (e.g., to the reflector 22), a forwardly projecting member 120 that extends from the base 110, and an electrically conductive horizontal component shaping element 130 that is coupled to the forwardly projecting member 120. In an example embodiment, the parasitic assembly 100 may be a monolithic assembly that is formed from a piece of sheet metal that is stamped and bent into the shape illustrated in FIG. 5.

The base 110 may comprise a planar strip of metal that may, for example, be mounted on the reflector 22 of the antenna 10 of FIGS. 1-3. The base 110 may be coplanar with the reflector and may be capacitively coupled to the reflector through a dielectric gasket 140. The base 110 may include one or more openings 112 that are configured to receive screws, rivets or other fasteners that may be used to mount the parasitic assembly 100 to the reflector 22. The amount of capacitive coupling between the base 110 and the reflector 22 may be selected to tune the impact that the parasitic assembly 100 has on the antenna beam formed by a radiating element mounted adjacent the parasitic assembly 100. Moreover, while capacitive coupling between the base 110 and the reflector 22 is typically preferred in order to prevent the generation of passive intermodulation distortion, it will be appreciated that direct galvanic connections between the reflector 22 and the parasitic assembly 100 may be used in some cases. While an electrical connection between the parasitic assembly 100 and the reflector 22 could be omitted in some embodiments, in the absence of such a connection, the parasitic assembly 100 tends to have an increased effect on the vertical component of the antenna beam generated by a radiating element that is mounted adjacent the parasitic assembly 100.

The forwardly projecting member 120 extends forwardly from the base 110. In the depicted embodiment, the forwardly projecting member 120 extends forwardly from the base 110 at an angle of about 90 degrees. In the depicted embodiment, the forwardly projecting member 120 is a planar strip of metal. A distance D that the forwardly projecting member 120 extends in the depth direction may be set so as to mount the horizontal component shaping element 130 at a preselected distance in front of the reflector 22.

The horizontal component shaping element 130 may be connected to a distal end of the forwardly projecting member 120. The horizontal component shaping element 130 may comprise a planar strip of metal in an example embodiment. The horizontal component shaping element 130 may extend from the forwardly projecting member 120 at an angle so that the horizontal component shaping element 130 may extend substantially parallel to the plane defined by the reflector 22. The horizontal component shaping element 130 includes a proximate side 132 that may be directly connected to the forwardly projecting member 120 and a distal side 134 that is opposite the proximate side. The distal side 134 of the horizontal component shaping element 130 may be electrically connected to the reflector only through the proximate side 132 of the horizontal component shaping element 130.

When a radiating element 42 (see FIG. 6) that is mounted adjacent the parasitic assembly 100 is excited, it will generate current flow on the reflector 22 of the base station antenna. The distribution of this current on the reflector 22 impacts the shape of the generated radiation pattern (antenna beam). The parasitic assembly 100 may be used to alter the current flow distribution on the reflector 22 in a manner that changes characteristics of the antenna beam in a desired manner. Moreover, since the parasitic assembly 100 will primarily affect the horizontal component of the antenna beam, it may be much easier to iteratively modify the design of the horizontal component shaping element until the horizontal and vertical components are sufficiently similar such that acceptable cross-polarization discrimination performance is achieved.

Figure 6:
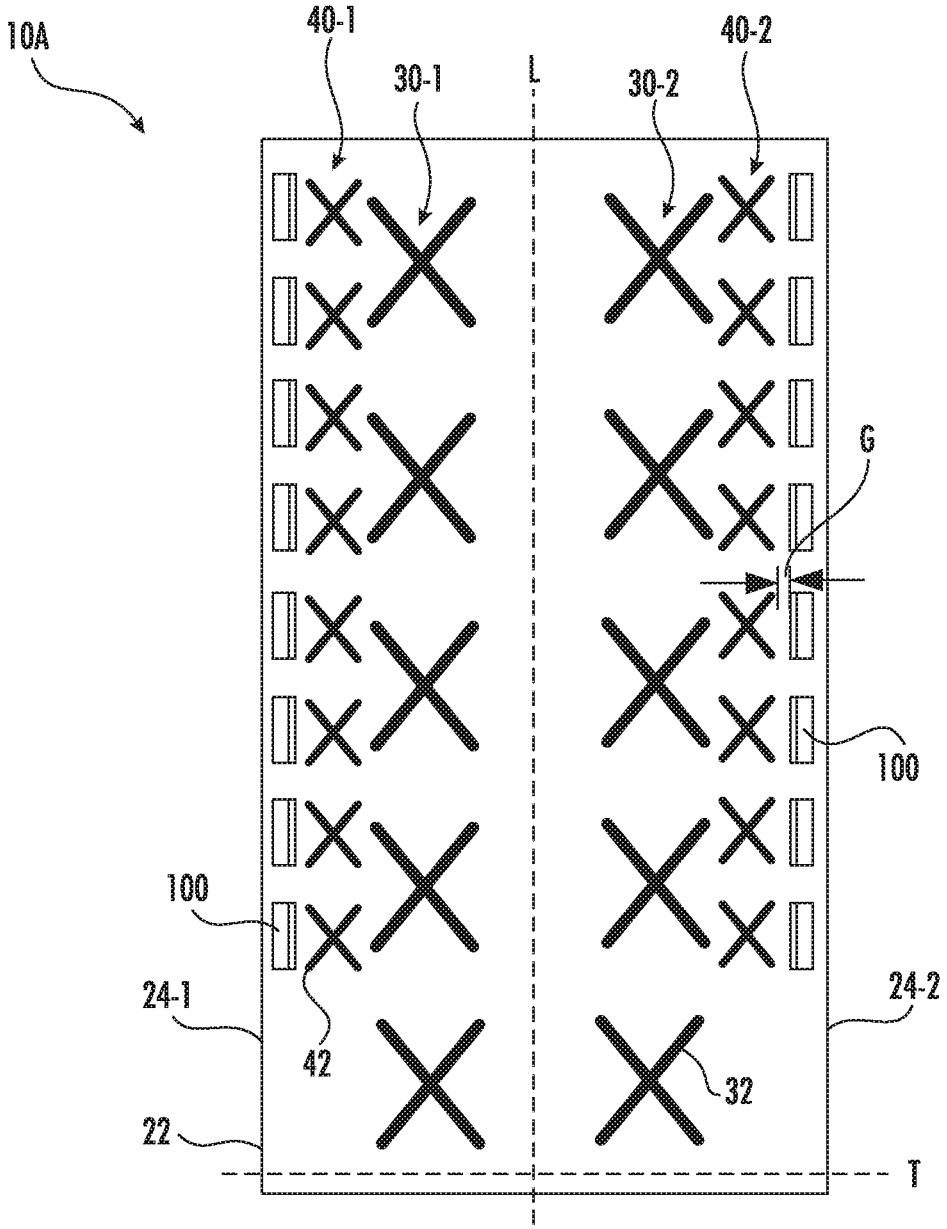
FIG. 6 is a schematic front view of a base station antenna that includes a plurality of the parasitic assemblies of FIG. 5.

FIG. 6 is a schematic front view of a base station antenna 10A according to embodiments of the present invention. As shown in FIG. 6, the base station antenna 10A includes a first and second linear arrays 30-1, 30-2 of low-band radiating elements 32, first and second linear arrays 40-1, 40-2 of mid-band radiating elements, and a plurality of parasitic assemblies. While not shown in FIG. 6, the antenna 10A may further include, for example, one or more linear arrays 50 of high-band radiating elements 52. As shown in FIG. 6, a parasitic assembly 100 may be positioned adjacent a first side of each radiating element 42. Each parasitic assembly 100 may extend forwardly from the reflector 22 and may be mounted to the reflector 22 by, for example, fasteners such as plastic screws (not shown). In the embodiment of FIG. 6, each parasitic assembly 100 is positioned outwardly in the transverse direction T from a respective one of the mid-band radiating elements 42 such that each parasitic assembly 100 is mounted between a mid-band radiating element 42 and a transverse edge 24 of the reflector 22. In the depicted embodiment, the base 110 of each parasitic assembly 100 is directly adjacent the respective radiating element 42 and the horizontal component shaping element 130 of each parasitic assembly 100 extends from the forwardly projecting member 120 away from the respective radiating element 42. It will be appreciated, however, that in other embodiments each parasitic assembly 100 may be rotated 180 degrees so that the base 110 is mounted outwardly of the forwardly projecting member 120 and the horizontal component shaping element 130 is mounted inwardly of the forwardly projecting member 120 to be closer to the associated radiating element 42. Each parasitic assembly 100 may primarily alter a horizontal component of the antenna beams of the radiating element 42 mounted adjacent thereto.

In some embodiments, the parasitic assemblies 100 may be configured to alter the horizontal components of the first and second antenna beams that are generated by an array 40 of radiating elements, weighted by power, at least twice as much as the respective vertical components of the first and second antenna beams. Stated in terms of FIGS. 8A and 8B, the area between the two curves in FIG. 8A, weighted by power, is at least twice the area between the two curves in FIG. 8B, weighted by power.

The horizontal component shaping element 130 of each parasitic assembly 100 may be positioned a first distance forwardly of the reflector 22, and the bottom edges of the dipole radiators may be positioned at a second distance forwardly of the reflector 22, where the second distance is greater than the first distance.

Figure 7A:
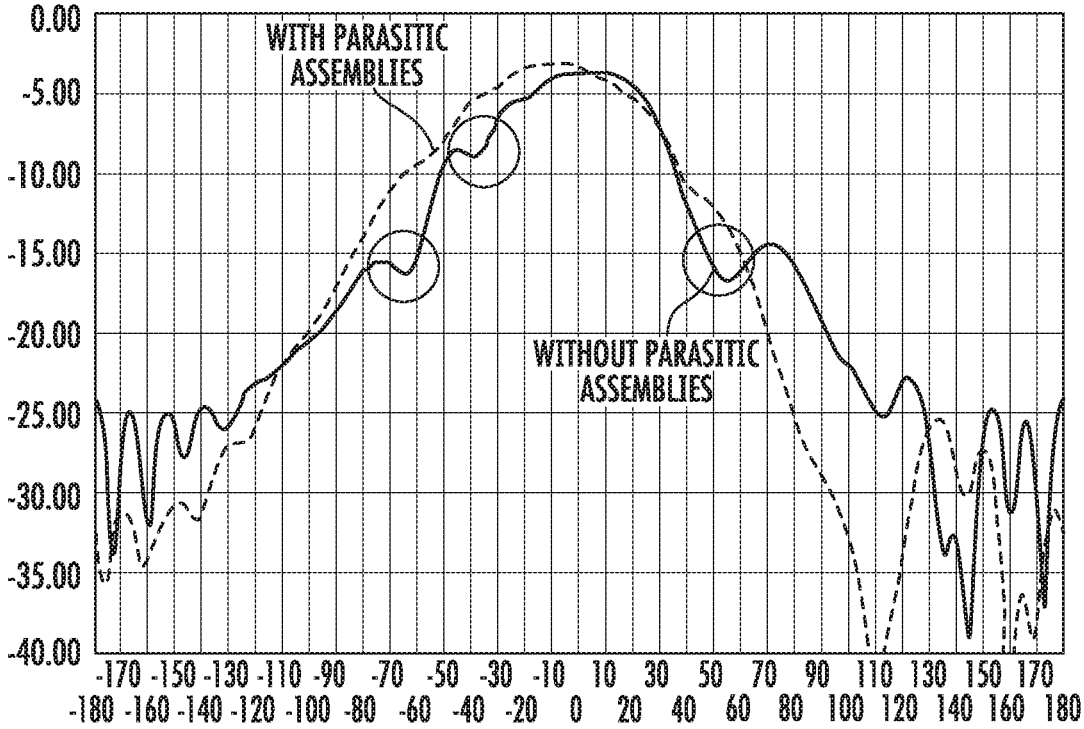
FIGS. 7A and 7B are graphs comparing the horizontal component (FIG. 7A) and the vertical component (FIG. 7B) of the simulated azimuth pattern of one of the mid-band linear arrays of the base station antenna of FIG. 6.
Figure 7B:
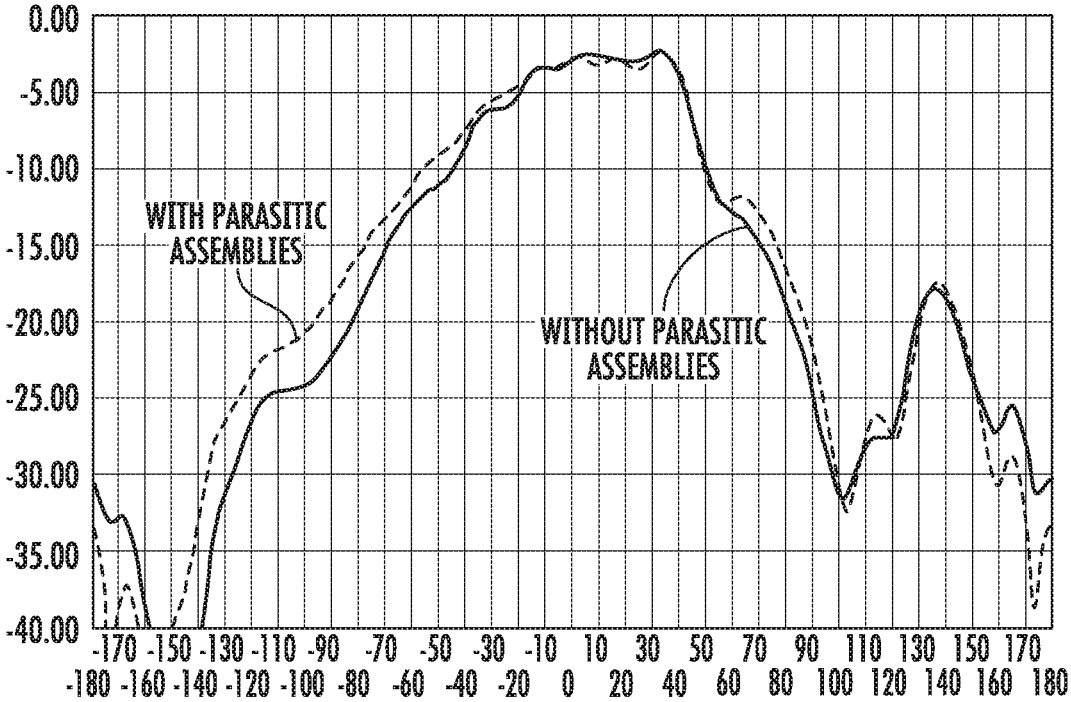

FIGS. 7A and 7B are graphs comparing the horizontal component (FIG. 7A) and the vertical component (FIG. 7B) of the simulated boresight azimuth pattern of one of the mid-band linear arrays 40 of FIG. 6, both with and without the parasitic assemblies 100 included in the antenna 10A of FIG. 6.

The curve labelled "Without Parasitic Assemblies" in FIG. 7A illustrates the horizontal component of the boresight azimuth pattern of an antenna beam formed by one of the mid-band linear arrays 40 included in the base station antenna 10A of FIG. 7A in the case where the parasitic assemblies 100 are omitted from the base station antenna 10A. As shown in FIG. 7A, the horizontal component of the boresight azimuth pattern has "nulls" within the azimuth angles covered by the sector (i.e., from about −65° to about 60°). Referring to the curve labeled "Without Parasitic Assemblies" in FIG. 7B, it can be seen that such nulls are not seen in the vertical component of the boresight azimuth pattern for the azimuth angles covered by the sector.

An antenna beam having, for example, a slant −45° polarization may be formed by combining equal amounts of radiation having horizontal and vertical polarizations in all directions. As such, to achieve perfect slant 45° polarization, the horizontal component and the vertical component should be identical. Thus, the similarity between the corresponding curves in FIGS. 7A and 7B provides an indication of the cross-polarization discrimination performance of the antenna. Since the above-discussed nulls in the curves labelled "Without Parasitic Assemblies" only appear in the horizontal component (FIG. 7A) and not in the vertical component (FIG. 7B), they represent differences in the two components that result in degraded cross-polarization discrimination.

The curve labelled "With Parasitic Assemblies" in FIG. 7A illustrates the horizontal component of the boresight azimuth pattern of an antenna beam formed by one of the mid-band linear arrays 40 included in the base station antenna 10A in the case where the parasitic assemblies 100 are included in the base station antenna. As shown in FIG. 7A, the nulls that were present at azimuth angles of about −65°, −40° and 65° are substantially eliminated when the parasitic assemblies 100 are added to base station antenna 10A. The curve labelled "With Parasitic Assemblies" in FIG. 7B illustrates the vertical component of the boresight azimuth pattern of the antenna beam formed by one of the mid-band linear arrays 40 included in the base station antenna 10A in the case where the parasitic assemblies 100 are included in base station antenna 10A. As can be seen, the addition of the parasitic assemblies 100 has almost no impact on the vertical component of the antenna beam for azimuth angles within the sector covered by the antenna beam. Thus, FIGS. 7A and 7B demonstrate that the parasitic assemblies 100 according to embodiments of the present invention may be designed to primarily affect the horizontal component of the azimuth pattern and hence may be used to improve the horizontal component of the antenna beam without substantially impacting the vertical component. Thus, the parasitic assemblies 100 according to embodiments of the present invention may be used to improve the horizontal component of an antenna beam without substantially impacting the vertical component, which may be a convenient technique for resolving issues with the cross-polarization performance of an array of radiating elements.

The parasitic assemblies according to embodiments of the present invention may be configured to primarily affect the horizontal component within a sub-portion of the operating frequency band. Referring again to FIG. 5, the portion of the operating frequency band that may be primarily impacted by the parasitic assembly 100 may be dependent on (1) the surface area of the base 110 (which impacts the degree of coupling with the reflector 22), (2) the thickness and dielectric constant of the insulating gasket 140 (which similarly impacts the degree of coupling with the reflector 22), the distance at which the horizontal component shaping element 130 is mounted forwardly of the reflector 22 (which, if the forwardly projecting member 120 extends at a right angle from the base 110, may be the distance D shown in FIG. 5) and (4) the width W (see FIG. 5) of the horizontal component shaping element 130 in the transverse direction. The height H of the horizontal component shaping element 130 in the vertical direction primarily impacts the magnitude of the effect. Accordingly, in some embodiments of the present invention, one or more of (1) surface area of the base 110, (2) the thickness and dielectric constant of the insulating gasket 140, (3) the extent to which the forwardly projecting member 120 projects forwardly, and/or (4) the width of the horizontal component shaping element 130 in the transverse direction may be selected so that the horizontal component shaping element 130 will primarily alter the cross-polarization discrimination performance of an array of radiating elements in a selected sub-band of the operating frequency range thereof.

Figure 8B:
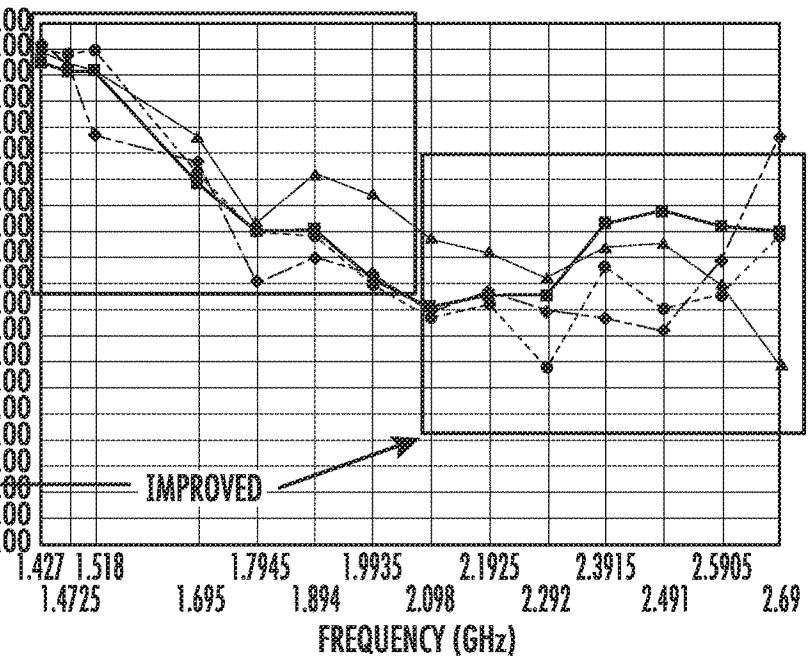
FIGS. 8A and 8B are graphs showing the sector cross-polarization ratio as a function of frequency for one of the mid-band linear arrays of FIG. 6 when the parasitic assemblies are not (FIG. 8A) and are (FIG. 8B) included in the antenna.
Figure 8A:
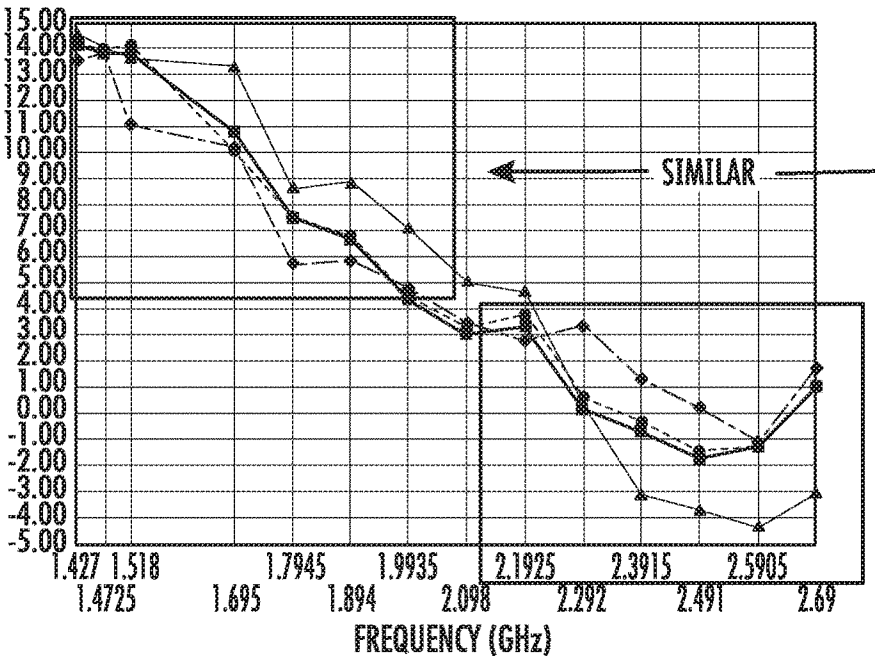

FIGS. 8A and 8B are graphs showing the sector cross-polarization discrimination ratio as a function of frequency for one of the mid-band linear arrays 40 of FIG. 6, with FIG. 8A illustrating the sector cross-polarization ratio performance when the base station antenna 10A of FIG. 6 does not include any parasitic assemblies 100 and FIG. 8B illustrating the sector cross-polarization ratio performance when the base station antenna 10A includes parasitic assemblies 100 according to embodiments of the present invention. In FIGS. 8A and 8B, the four separate curves included in each graph represent illustrate the cross-polarization discrimination ratio for each of the two polarizations (slant −45° and slant +45°) at electronic downtilts of 00 and 12°.

As shown in FIG. 8A, the cross-polarization discrimination ratio may vary with frequency across the operating frequency band of the mid-band radiating element 42. For the particular mid-band radiating elements 42 included in the mid-band linear 40 (see FIG. 4), the operating frequency band is the 1.427-2.690 GHz frequency band, which is the frequency range covered by the graphs of FIGS. 8A-8B. As shown in FIG. 8A, the cross-polarization discrimination ratio decreases with increasing frequency (which indicates degraded cross-polarization discrimination performance), and the performance levels in the 2.2-2.69 GHz frequency range are unsuitable for many applications.

FIG. 8B illustrates how the parasitic assemblies 100 according to embodiments of the present invention may be used to improve the cross-polarization discrimination ratio in a selected portion of the operating frequency band of the linear array 40. In particular, as can be seen by comparing FIGS. 8A and 8B, the cross-polarization discrimination ratio in the 1.427-2.1 GHz frequency range is quite similar in the cases where the base station antenna did (FIG. 8B) and did not (FIG. 8A) include the parasitic assemblies 100 according to embodiments of the present invention. However, in the 2.1-2.69 GHz frequency range, it can be seen that adding the parasitic assemblies 100 to the antenna 10A resulted in about a 6 dB improvement in the cross-polarization discrimination ratio performance.

Referring again to FIG. 6, it can be seen that each parasitic assembly 100 is offset from an associated radiating element 42 by a transversely-extending gap G. The gap G may, for example, be a distance of between 2 and 20 wavelengths of the center frequency of the operating frequency band of the radiating element 42. In other embodiments, the gap G may be a distance of between 5 and 15 wavelengths of the center frequency of the operating frequency band of the radiating element 42, or between 6 and 10 wavelengths of the center frequency of the operating frequency band of the radiating element 42.

Figure 9:
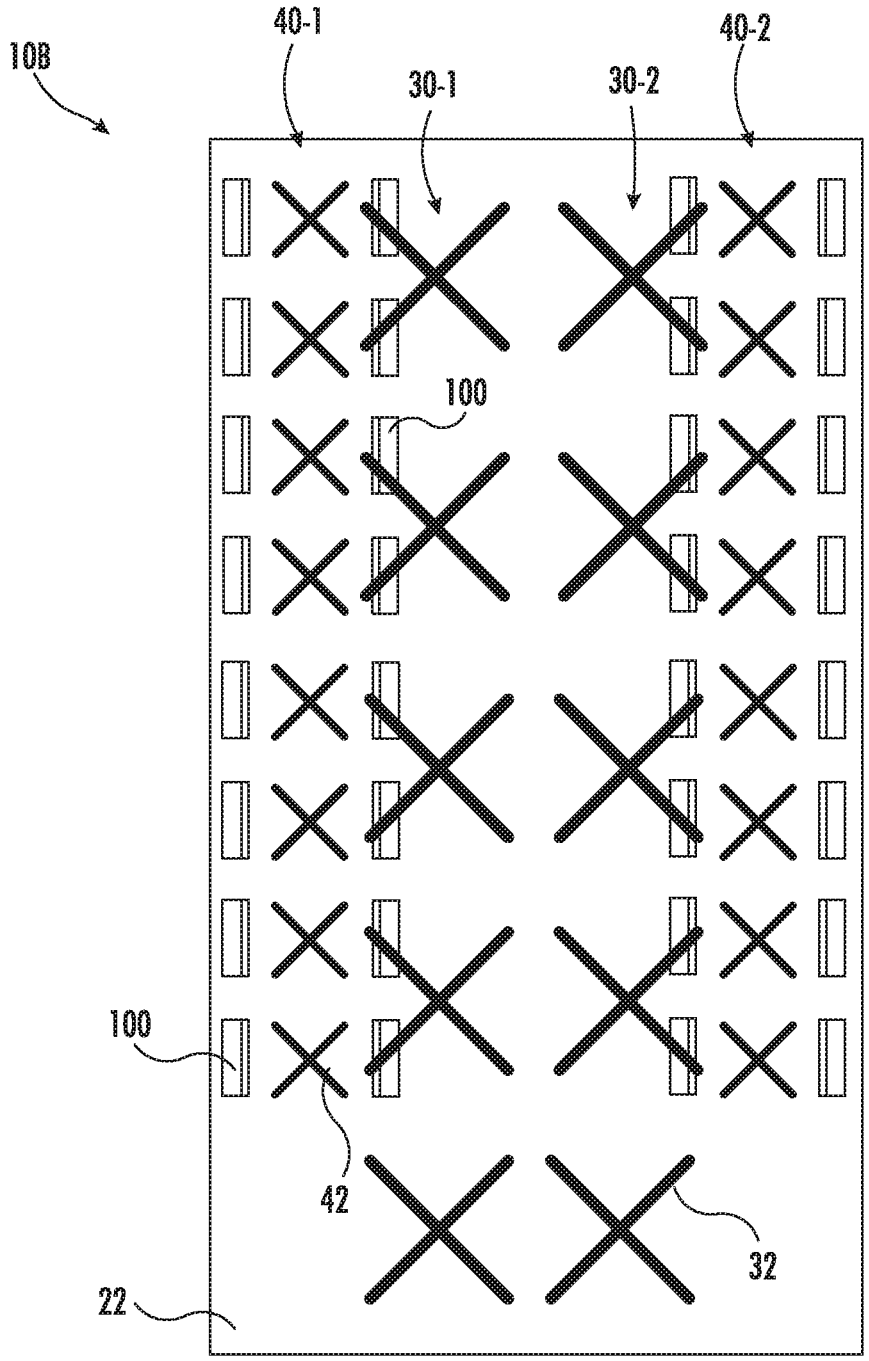
FIG. 9 is a schematic front view of a base station antenna according to embodiments of the present invention that includes parasitic assemblies mounted adjacent each side of each mid-band radiating element.
Figure 10:
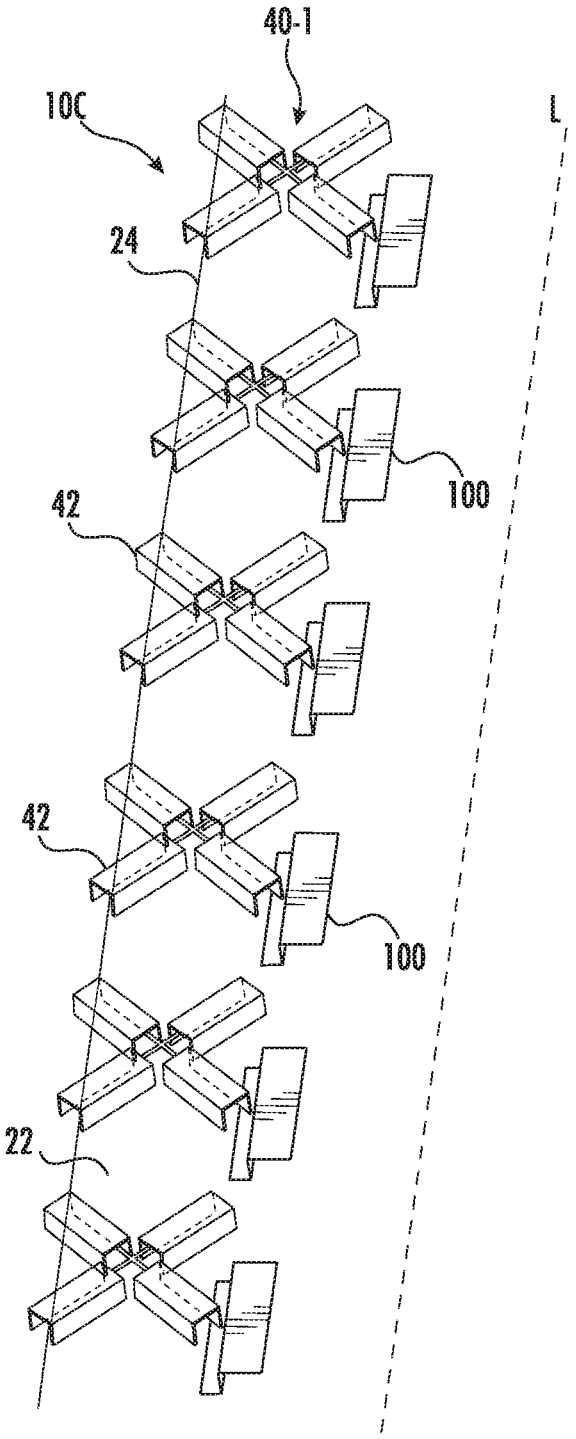
FIG. 10 is a schematic perspective view illustrating how the parasitic assemblies according to embodiments of the present invention may be mounted inwardly of their corresponding radiating elements.
Figure 11:
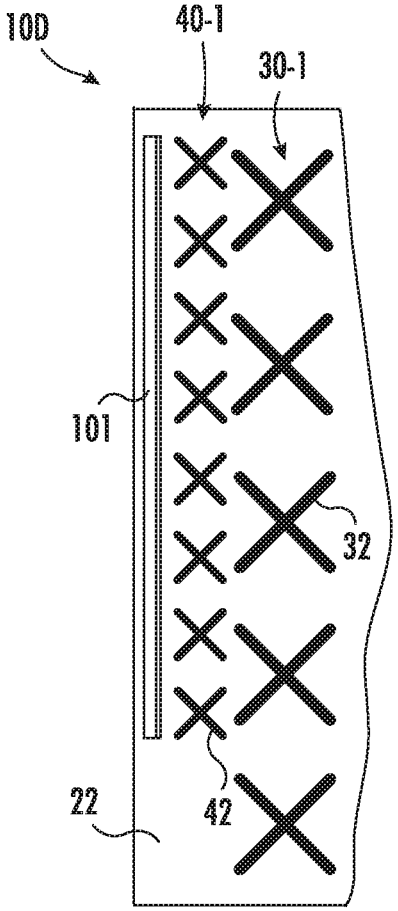
FIG. 11 is a schematic front view of a portion of a base station antenna illustrating how elongated parasitic assemblies may be used in some embodiments to shape the patterns of multiple radiating elements.

While FIG. 6 illustrates one example way in which the parasitic assemblies according to embodiments of the present invention may be mounted so as to primarily effect the horizontal component of the azimuth pattern of the antenna beam, it will be appreciated that embodiments of the present invention are not limited thereto. FIGS. 9-11 illustrate several alternative mounting schemes for the parasitic assemblies according to embodiments of the present invention.

Referring first to FIG. 9, which is a schematic front view of a base station antenna 10B according to further embodiments of the present invention, it can be seen that parasitic assemblies 100 are mounted on each side of each mid-band radiating element 42 included in the first and second mid-band linear arrays 40. This arrangement may increase the effect that the parasitic assemblies 100 have on the horizontal component. Moreover, it will be appreciated that if the radiating elements 42 are balanced, then degradation in the cross-polarization discrimination performance of a linear array may primarily be due to environmental factors in the antenna such as radiating elements that operate in other frequency bands, the edge of the reflector and the like. Such environmental factors may or may not be present on both sides of a radiating element. Thus, in some case it may be advantageous to provide parasitic assemblies on both sides of some or all of the radiating elements, while in other cases providing parasitic assemblies only on one side of the radiating elements may provide better performance.

FIG. 10 is a schematic perspective view of a portion of another base station antenna 10C according to embodiments of the present invention. In order to simplify the drawing, only a linear single array 40 of mid-band radiating elements 42 is depicted (and only the dipole radiators of the radiating elements 42 are shown) along with a portion of the reflector 22. As shown in FIG. 10, in the base station antenna 10C, the parasitic assemblies 100 are mounted inwardly of the mid-band radiating elements 42 (i.e., between the radiating elements 42 and a longitudinal axis L extending vertically through the center of the reflector 22) as opposed to between the mid-band radiating elements 42 and a transverse edge 24 of the reflector 22.

It will likewise be appreciated that a single parasitic assembly may be used with respect to multiple radiating elements. FIG. 11 is a schematic front view of a portion of a base station antenna 10D that includes a single parasitic assembly 101 that is used to impact the horizontal component of the azimuth pattern of the antenna beam for an entire linear array 40-1 of radiating elements 42. The parasitic assembly 101 shown in FIG. 11 may be identical to the parasitic assembly 100 discussed above with reference to FIG. 5, but is significantly elongated in the vertical direction. It will also be appreciated that parasitic assemblies may be provided that are elongated so that they can be placed adjacent more than one, but less than all, of the radiating elements in a linear array.

Figure 12A:
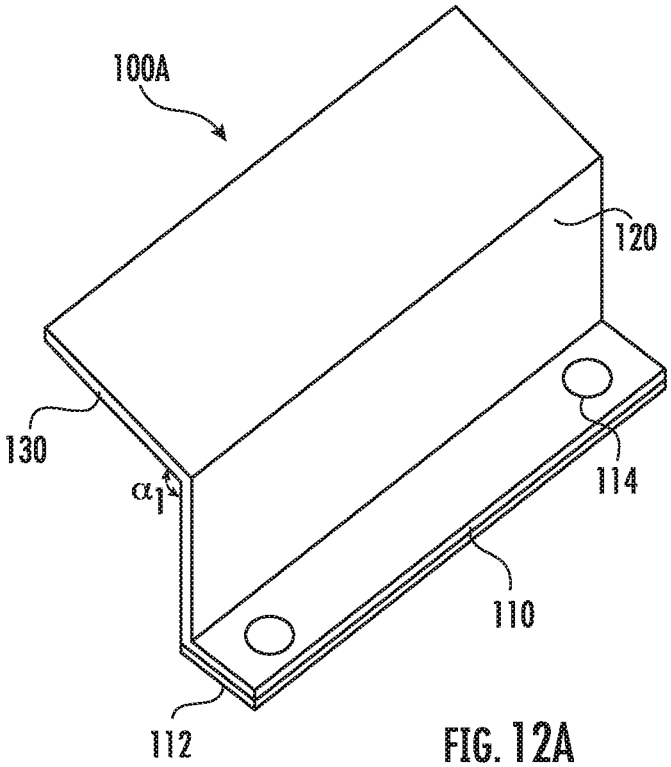
FIG. 12A is a perspective view of a parasitic assembly according to further embodiments of the present invention that has a horizontal component shaping element that is not parallel with the plane defined by the reflector.
Figure 12B:
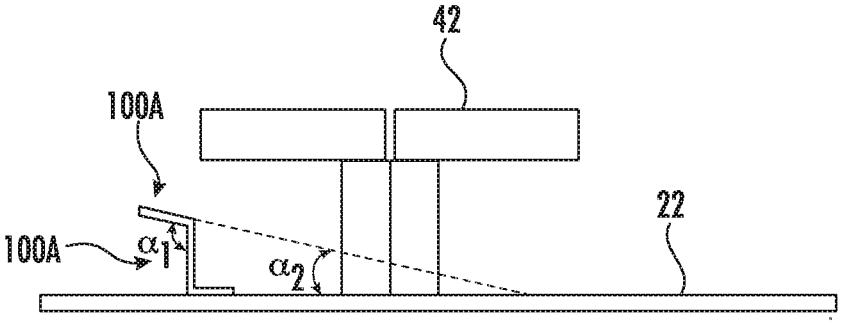
FIG. 12B is a schematic top view of the parasitic assembly of FIG. 12A mounted on a reflector.

It will also be appreciated that many changes may be made to the parasitic assembly 100 of FIG. 5 without departing from the scope of the present invention. For example, FIGS. 12A and 12B illustrate a parasitic assembly 100A according to further embodiments of the present invention that includes a horizontal component shaping element that is mounted so that it does not extend parallel to a plane defined by the reflector 22. FIG. 12A is a perspective view of the parasitic assembly 100A, while FIG. 12B is a schematic top view of the parasitic assembly 100A mounted on the reflector 22.

As shown in FIG. 12A, the parasitic assembly 100A is very similar to the parasitic assembly 100 of FIG. 5, and includes a mounting base 110 that is configured to be mounted to the reflector 22, a forwardly projecting member 120 that extends from the base 110, and a horizontal component shaping element 130 that is coupled to the forwardly projecting member 120. However, in the parasitic assembly 100A, the horizontal component shaping element 130 extends from the forwardly projecting member 120 at an angle at. In embodiments where the forwardly projecting member 120 extends from the base 110 at a 90° angle, the horizontal component shaping element 130 will extend at the angle $\alpha_2=\alpha_1-90$ with respect to the reflector 22, as is shown in FIG. 12B. Typically, the angle $\alpha_2$ will be a relatively small angle such as an angle of between 0° and 30°, or an angle between 0° and 20°, or an angle between 0° and 10°.

Figure 13A:
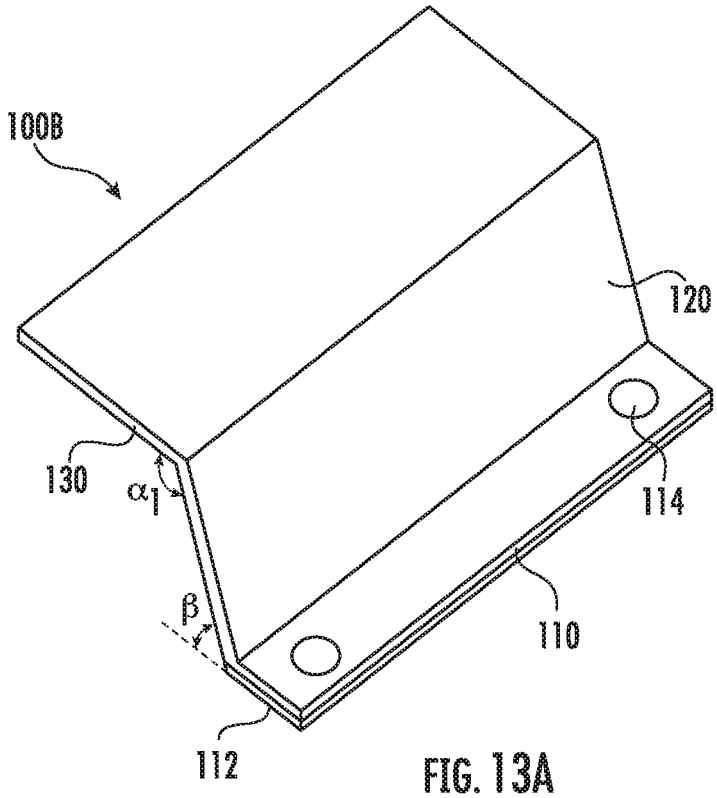
FIG. 13A is a perspective view of a parasitic assembly according to additional embodiments of the present invention that has an outwardly projecting member that is not perpendicular to plane defined by the reflector.
Figure 13B:
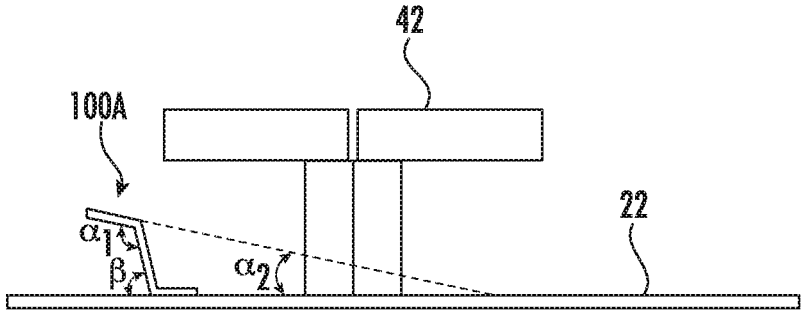
FIG. 13B is a schematic top view of the parasitic assembly of FIG. 13A mounted on a reflector.

FIG. 13A is a perspective view of a parasitic assembly 100B according to additional embodiments of the present invention that has an outwardly projecting member 120 that is not perpendicular to plane defined by the reflector 22. FIG. 13B is a schematic top view of the parasitic assembly 100B mounted on the reflector 22.

The parasitic assembly 100B is identical to the parasitic assembly 100A of FIGS. 12A-12B in all respects except that in the parasitic assembly 100B, the outwardly projecting member 120 extends upwardly from the reflector 22 at an angle 3 that may be different from 90°. As shown in FIG. 13B, in this more general case, the horizontal component shaping element 130 will extend at the angle $\alpha_2=\alpha_1-\beta$ with respect to the reflector 22. Thus, it will be appreciated that the angles $\alpha_1$ and $\beta$ need not be 90° angles in the parasitic assemblies according to embodiments of the present invention.

Generally speaking, when the horizontal component shaping element 130 extends in parallel with the plane defined by the reflector 22 or at a small angle ($\alpha_2$) thereto, the parasitic assembly will primarily impact the horizontal component of the azimuth pattern of the antenna beam. As the angle $\alpha_2$ increases, however, the parasitic assembly may have an increasing impact on the vertical component of the azimuth pattern of the antenna beam. In some embodiments, the angle $\alpha_2$ may be less than 45°. In other embodiments, the angle $\alpha_2$ may be less than 20°. In still other embodiments, the angle $\alpha_2$ may be less than 15°, or less than 10°. In some embodiments, the angle $\alpha_2$ may be about less than 0°.

Figure 14:
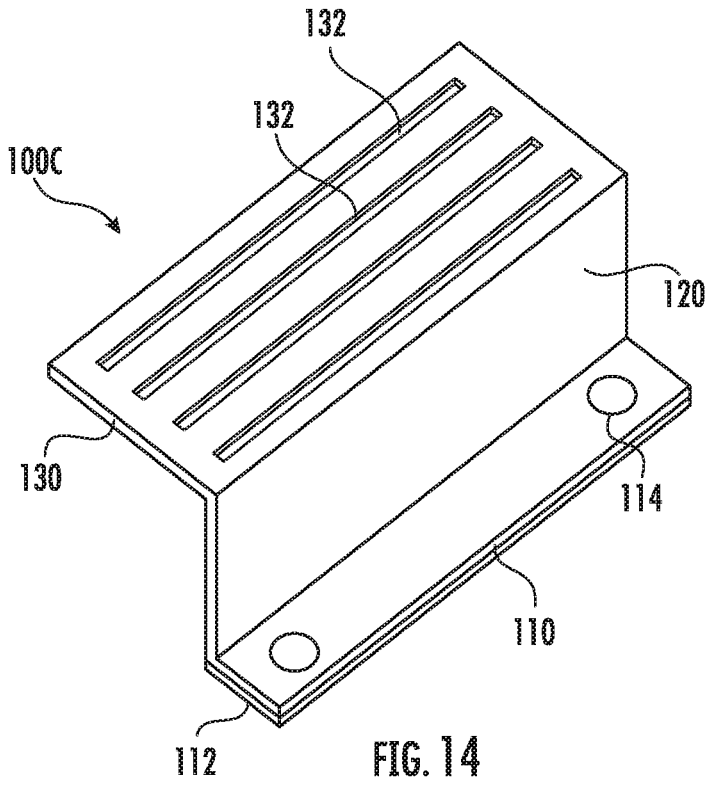
FIG. 14 is a perspective view of a parasitic assembly according to yet additional embodiments of the present invention that has slot-like openings in its horizontal component shaping element.

FIG. 14 is a perspective view of a parasitic assembly 100C according to yet additional embodiments of the present invention that has slot-like openings in its horizontal component shaping element 130. As shown in FIG. 14, the parasitic assembly 100C is very similar to the parasitic assembly 100 of FIG. 5, and includes a mounting base 110, a forwardly projecting member 120 that extends from the base 110, and a horizontal component shaping element 130 that is coupled to the forwardly projecting member 120. However, in the parasitic assembly 100C, the horizontal component shaping element 130 includes one or more longitudinally-extending slots 132 (which slots 132 will typically have a vertical orientation when the parasitic assembly 100C is integrated into a base station antenna and the antenna is mounted for use). The longitudinally-extending slots 132 may be used to tune the impact that the parasitic assembly 100C has on the horizontal component of the azimuth pattern, with the number of slots 132, the location of the slots 132, and the width of the slots 132 being parameters that may be adjusted to tune the horizontal component.

Figure 15:
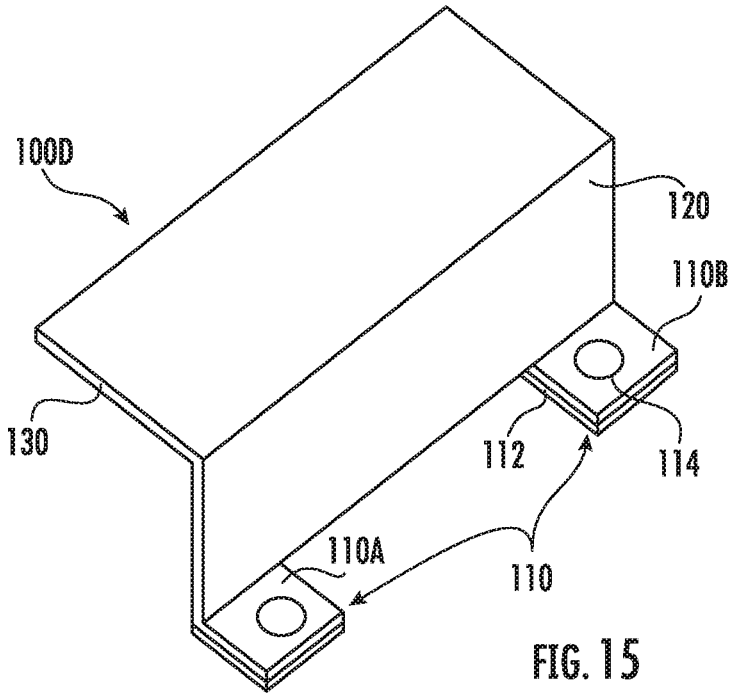
FIG. 15 is a perspective view of a parasitic assembly according to still further embodiments of the present invention that has a pair of tabs that form the base thereof.

While in the above-described parasitic assemblies 100 and 100A-100C the base 110 is implemented as a planar plate-like member that extends the same distance in the vertical direction as the forwardly projecting member 120 and the conductive horizontal component shaping element 130, it will be appreciated that embodiments of the present invention are not limited thereto. For example, FIG. 15 is a perspective view of a parasitic assembly 100D according to still further embodiments of the present invention that has a pair of tabs 110A, 110B that form the base 110 thereof. As shown in FIG. 15, the tabs 110A, 110B may be quite small, and may primarily provide a mechanism for mounting the parasitic assembly 100D on the reflector 22 of a base station antenna. However, as discussed above, it will also be appreciated that the base 110 may have a second function of providing an electrical connection between the horizontal component shaping element 130 and the reflector 22. In order to reduce the likelihood that passive intermodulation distortion develops due to an inconsistent metal-to-metal connection between the base 110 and a reflector 22 of an antenna 10, the electrical connection between the base 110 and the reflector 22 is typically implemented as a capacitive connection. The amount of coupling between the base 110 and the reflector 22 will typically effect the impact that the parasitic assembly 100D has on the horizontal component of the azimuth pattern of the antenna beam, and hence a minimum level of capacitive coupling may be required in various applications. All else being equal (such as the thickness of the gasket 140 and the dielectric constant thereof), the magnitude of the capacitive coupling is directly proportional to the surface area of the rear surface(s) of the base 110. Thus, the amount of capacitive coupling required may, in some cases, limit the extent to which the size of the tabs 110A, 110B may be reduced.

Figure 16:
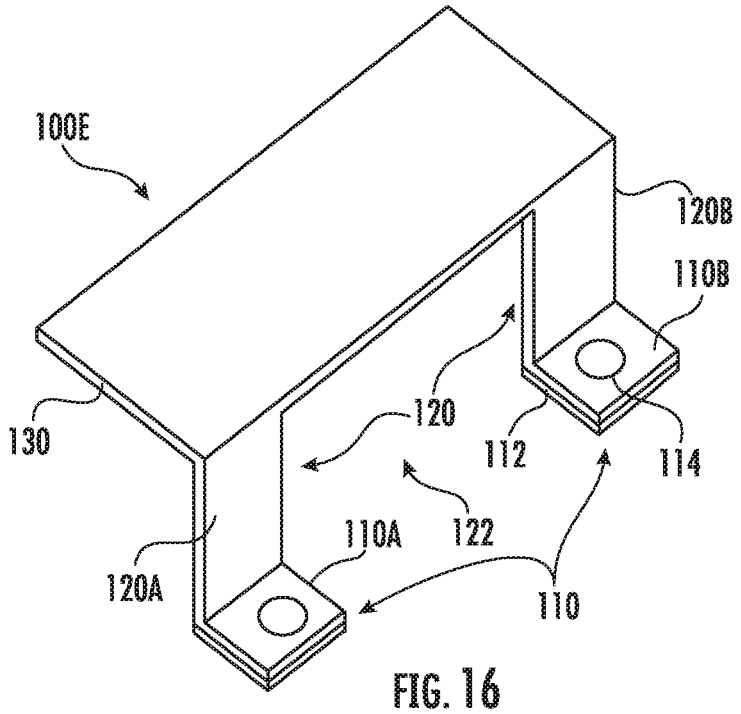
FIG. 16 is a perspective view of a parasitic assembly according to yet additional embodiments of the present invention that has an outwardly projecting member that is designed to have even further reduced impact on the vertical component of the azimuth pattern.

FIG. 16 is a perspective view of a parasitic assembly 100E according to yet additional embodiments of the present invention that has an forwardly projecting member 120 that is designed to have minimal impact on the vertical component of the azimuth pattern. As shown in FIG. 16, the forwardly projecting member 120 is implemented as a pair of tabs 120A, 120B that extend between the respective tabs 110A, 110B of the base 110 and the horizontal component shaping element 130 such that an opening 122 is provided in the forwardly projecting member 120. By reducing the surface area of the forwardly projecting member 120 it may be possible to further reduce the impact that the parasitic assembly 100E has on the vertical component of the azimuth pattern. While in the embodiment of FIG. 16 the entire middle portion of the forwardly projecting member 120 of parasitic assembly 100 (see FIG. 5) is removed, it will be appreciated that embodiments of the invention are not limited thereto. For example, a large opening may be stamped or otherwise formed in the forwardly projecting member 120 of parasitic assembly 100 in lieu of the tab structure 120A, 120B shown in FIG. 16. The general concept is reducing the surface area of the forwardly projecting member 120 that faces an associated radiating element in order to reduce the impact that the forwardly projecting member 120 may have on the antenna beam formed by the associated radiating element. In other embodiments, the forwardly projecting member 120 may be partly or fully constructed of a dielectric material to achieve the same effect.

Figure 17:
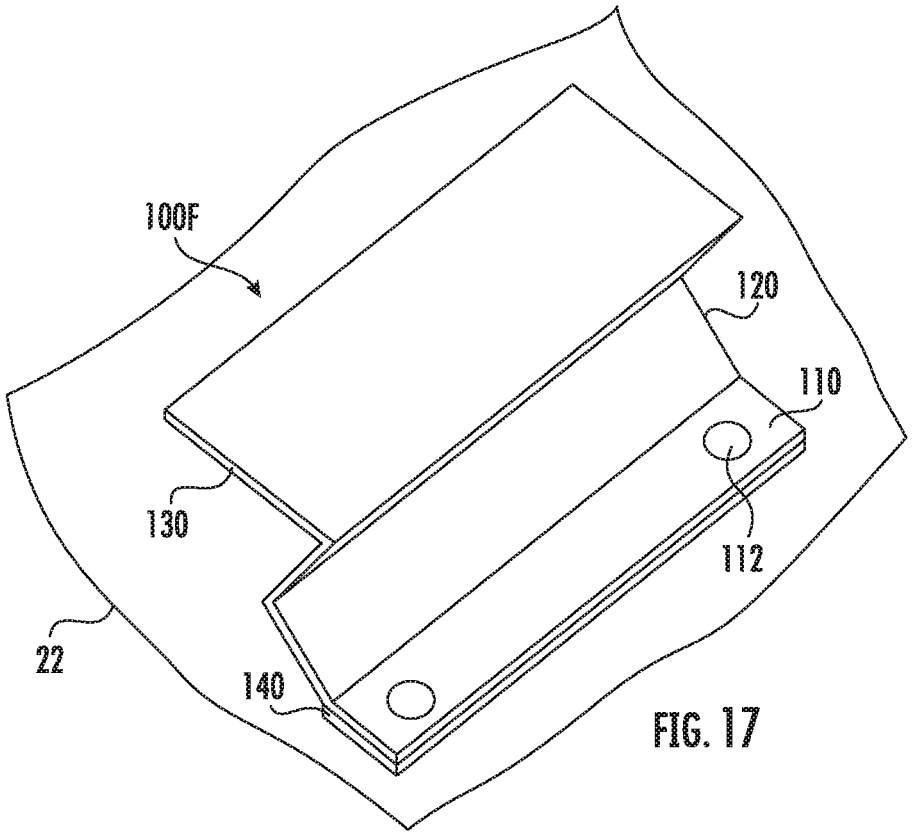
FIG. 17 is a perspective view of a parasitic assembly according to yet additional further embodiments of the present invention.

It will be appreciated that many modifications may be made to the above-described example embodiments without departing from the scope of the present invention. For example, while the base 110, forwardly projecting member 120 and horizontal component shaping element 130 are all shown as being planar structures in the figures, this need not be the case. For example, the forwardly projecting member 120 could be implemented as a bent piece of metal that includes one or more angled sections as shown, for example, in the parasitic assembly 100F of FIG. 17 or, alternatively, as a wavy or undulating plate. The same is true with respect to, for example, the horizontal component shaping element 130. Lips could also be added to any of the base 110, the forwardly projecting member 120 and/or the horizontal component shaping element 130. Thus, it will be appreciated that the embodiments disclosed herein are exemplary in nature and not limiting to the scope of the present invention.

Figure 18:
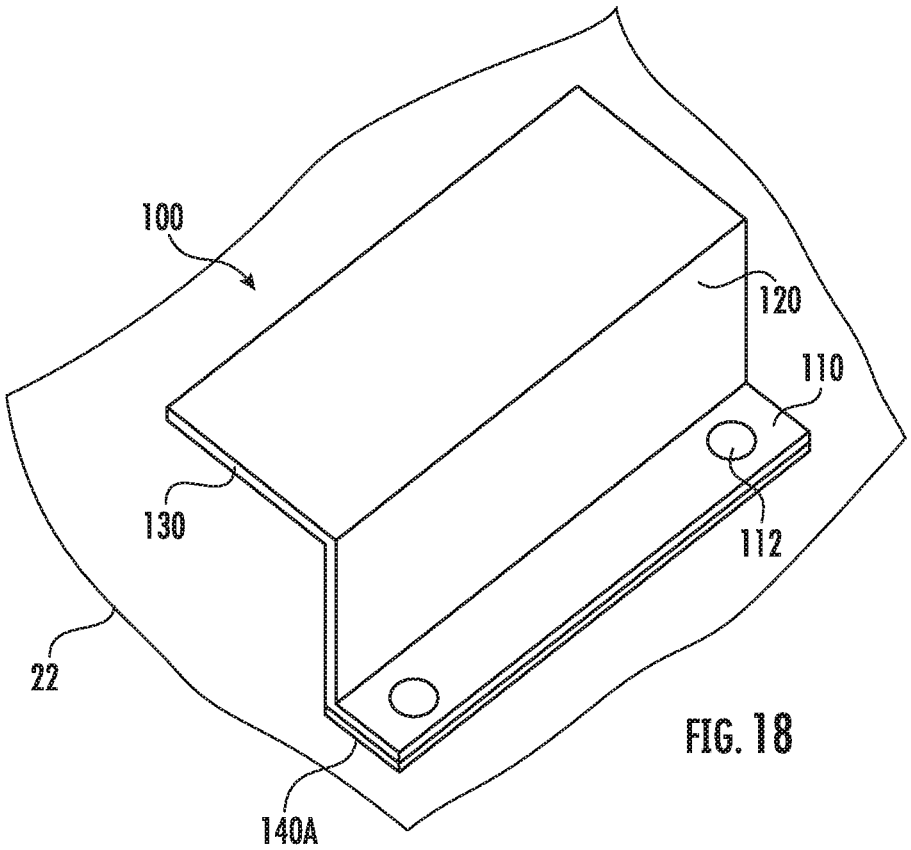
FIG. 18 is a schematic view of a dielectric coating sprayed onto a parasitic assembly according to the embodiments of the present invention.

While in the above-described example embodiments, the base 110 is capacitively coupled to the reflector 22 through the dielectric gasket 140, it will be appreciated that the parasitic assemblies 100, 100A, 100B, 100C, 100D, 100E, 100F according to embodiments of the present invention may employ other dielectric components to capacitively couple the bases thereof to the reflector 22. For example, as shown in FIG. 18, a dielectric coating 140A may be sprayed throughout the rear surface of the base 110 that faces the reflector 22, and the dielectric gasket 140 is omitted from the parasitic assembly 100. The dielectric coating 140A may be made of Teflon or any other dielectric material that is suitable for spraying. Similar to the dielectric gasket 140, the thickness and dielectric constant of the dielectric coating 140A may affect the horizontal component within a sub-portion of the operating frequency band. In manufacturing, the dielectric gasket 140 has to be bonded to the rear surface of the base 110 manually or by machines, and the openings in the dielectric gasket 140 may be misaligned with the openings 112 of the base 110 for screws, rivets or other fasteners if the bonding operation is not performed perfectly. The replacement of the dielectric gasket 140 with the dielectric coating 140A can avoid such alignment errors and also can advantageously reduce the number of components for assembly, and improves the efficiency of the assembly process.

Figure 19:
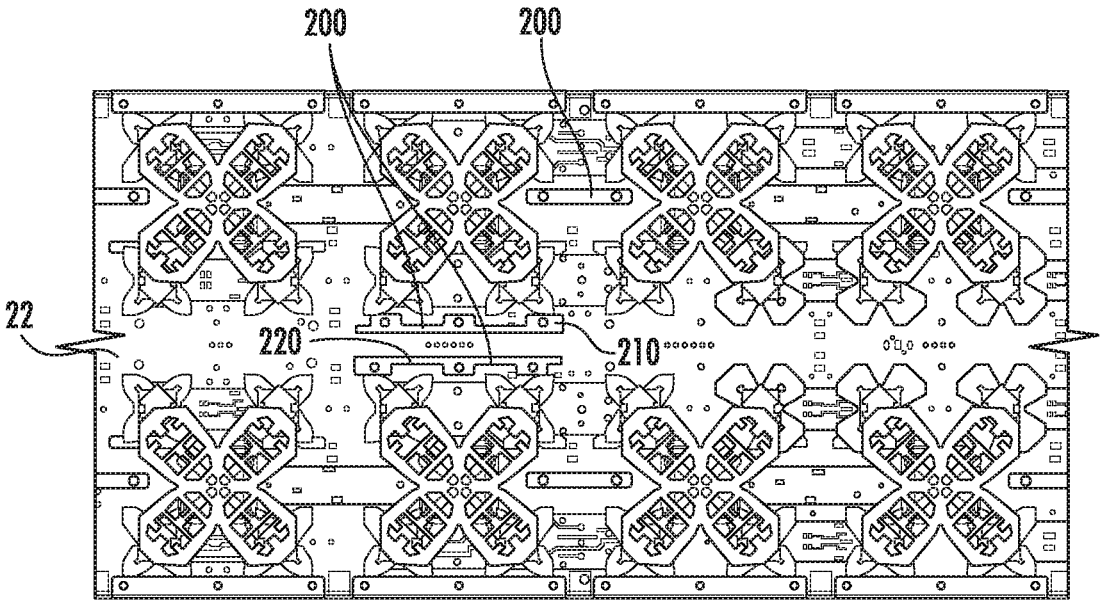
FIG. 19 is a schematic view of fence assemblies disposed on a reflector of the antenna assembly of the base station antenna of FIG. 1.
Figure 20A:
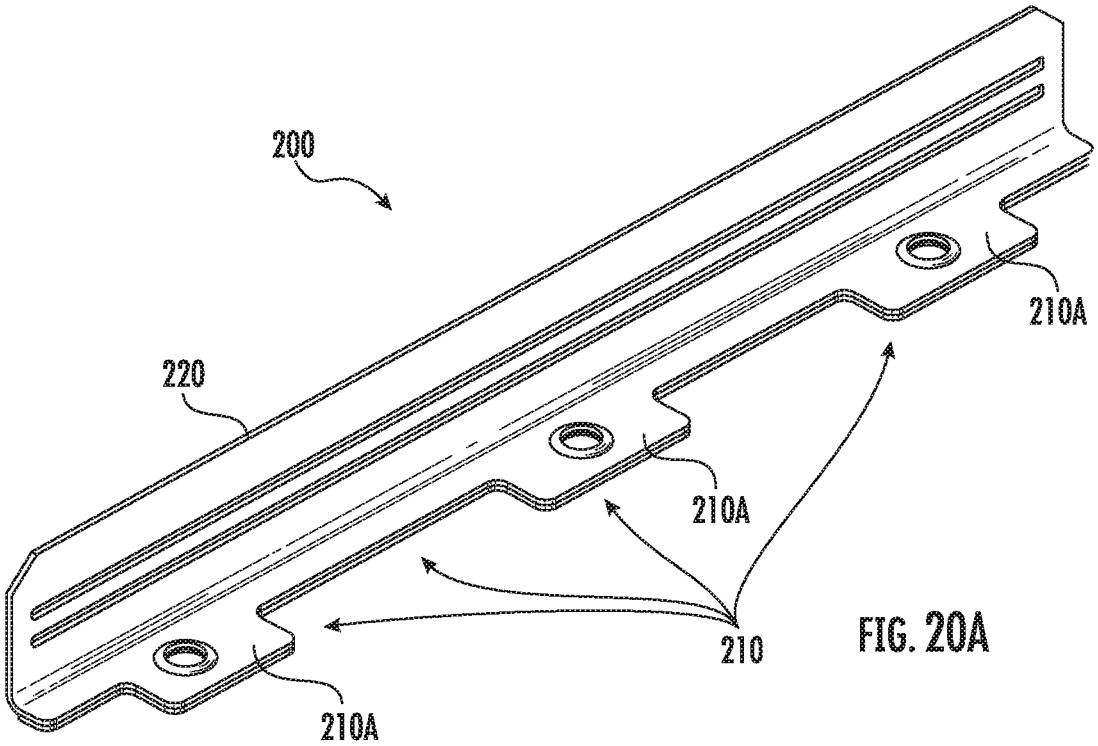
FIGS. 20A and 20B are schematic views of a dielectric coating sprayed onto a fence assembly other than the parasitic assembly according to the embodiments of the present invention.
Figure 20B:
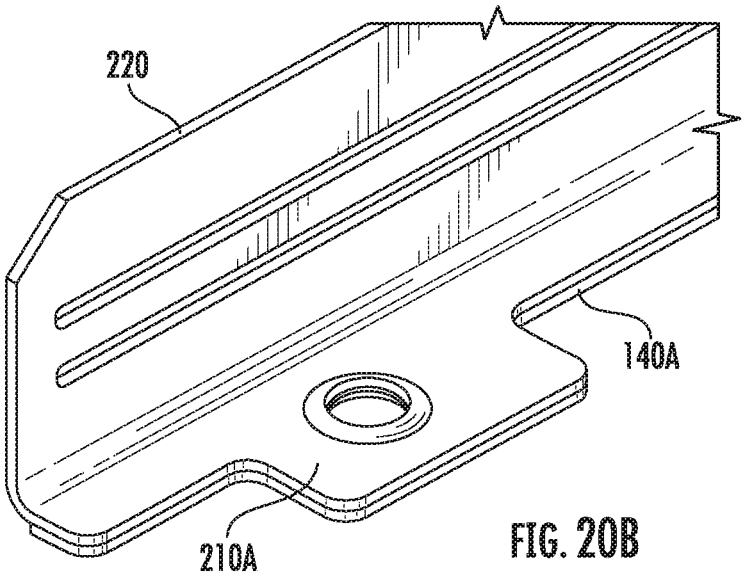

The dielectric coating 140A can also be used to implement capacitive junctions between other kinds of fence assemblies and a reflector. As shown in FIG. 19, other types of parasitic elements such as so-called fence assemblies 200 may be disposed between arrays of radiating elements on the reflector 22 of a base station antenna. The fence assemblies 200 may include a forwardly projecting member 220 and a base 210 (where in the depicted embodiment, some of the bases 210 comprise a plurality of tabs 210A) that support the forwardly projecting member 220 on the reflector 22, one example of which is shown in FIGS. 20A and 20B. A dielectric coating 140A may be sprayed throughout the rear surface of the base 210 that faces the reflector 22, and the dielectric coating 140A may be made of Teflon or any other dielectric material that is suitable for spraying. The dielectric coating 140A can also be extended to the other capacitive or non-capacitive junctions of the base station antenna, such as the junction between a back plate and a reflector, the junction between a beam and a plate such as a phase shifter plate, a coupler plate etc.

While embodiments of the present invention have primarily been discussed with reference to parasitic assemblies that are used to alter the horizontal component of the azimuth pattern of the antenna beams generated by cross-dipole mid-band radiating elements (i.e., radiating elements that operate in the 1.427-2.690 GHz frequency band or portions thereof), it will be appreciated that the parasitic assemblies according to embodiments of the present invention may be used with radiating elements that operate in any cellular frequency band as well as with other types of radiating elements such as, for example, patch radiating elements. The dimensions of the various components of the parasitic assemblies such as, for example, the extent to which the forwardly projecting member extends forwardly from the reflector and/or the length and width of the horizontal component shaping element, may be varied based on the operating frequency band of the radiating elements.

It will likewise be appreciated that different aspects of the above parasitic assemblies and base station antennas according to embodiments of the present invention may be combined to provide many additional embodiments. For example, any of the disclosed parasitic assemblies may include horizontal component shaping elements 130 that extend from the forwardly projecting member 120 at an angle different from 90°, and/or any of the disclosed parasitic assemblies may include forwardly projecting members 120 that extend from the base 110 at an angle different from 90°. Similarly, or any of the disclosed parasitic assemblies may include bases 110 and/or forwardly projecting members 120 that are implemented as tabs or structures other than plates as discussed above with reference to FIGS. 15 and 16. Any of the disclosed parasitic assemblies may also include the vertically-extending slots 132 discussed above with reference to FIG. 14. By mixing and matching these features, many additional parasitic assemblies according to embodiments of the present invention are provided.

Similarly, while FIGS. 6 and 9-11 illustrate example mounting positions for the parasitic assemblies according to embodiments of the present invention on a base station antenna using parasitic assembly 100 as an example, it will be appreciated that any of the parasitic assemblies according to embodiments of the present invention may be substituted for the parasitic assemblies 100 shown in these figures.

It will also be appreciated that while linear arrays of radiating elements are commonly used in base station antennas, other types of arrays of radiating elements including, for example, planar two-dimensional arrays (e.g., an M×N array where M and N are both integers greater than 1) and "staggered" linear arrays in which the radiating elements are generally aligned along a vertical axis, but one or more of the radiating elements are offset in a horizontal direction from the vertical axis, are also used in base station antennas. It will be appreciated that the parasitic assemblies disclosed herein may also be used with other types of arrays of radiating elements that are not strictly a "linear" array.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna, comprising:

a reflector that defines a substantially vertical plane;

a plurality of cross-polarized radiating elements that form a first array of radiating elements, the cross-polarized radiating elements mounted to extend forwardly from the reflector, and each cross-polarized radiating element including a −45° dipole radiator and a +45° dipole radiator; and a parasitic assembly mounted to extend forwardly from the reflector, the parasitic assembly including a base that is mounted on the reflector, a horizontal component shaping element, and a forwardly projecting member that projects forwardly from the base that is coupled between the base and the horizontal component shaping element, wherein the horizontal component shaping element is slanted less than 45° from the substantially vertical plane defined by the reflector, wherein the horizontal component shaping element includes a proximate side that is directly connected to the forwardly projecting member and a distal side that is opposite the proximate side, and wherein the distal side of the horizontal component shaping element is only electrically connected to the reflector through the proximate side of the horizontal component shaping element.

2. The base station antenna of claim 1, wherein the horizontal component shaping element is slanted between 0° and 15° with respect to the substantially vertical plane defined by the reflector.

3. The base station antenna of claim 2, wherein the parasitic assembly is mounted directly adjacent a first of the cross-polarized radiating elements and is between the first of the cross-polarized radiating elements and a transverse edge of the reflector.

4. The base station antenna of claim 1, wherein the horizontal component shaping element is slanted between 0° and 45° with respect to the substantially vertical plane defined by the reflector.

5. The base station antenna of claim 4, wherein the parasitic assembly comprises one of a plurality of parasitic assemblies, and the parasitic assemblies are mounted adjacent the respective cross-polarized radiating elements in the first array of radiating elements.

6. The base station antenna of claim 4, wherein an extent to which the forwardly projecting member projects forwardly is selected so that the horizontal component shaping element will primarily alter a cross-polarization discrimination performance of the first array in a selected sub-band of an operating frequency range of the first array of radiating elements.

7. The base station antenna of claim 4, wherein the horizontal component shaping element includes at least one slot.

8. The base station antenna of claim 4, wherein the horizontal component shaping element is positioned a first distance forwardly of the reflector, and a bottom edge the −45° dipole radiator is positioned a second distance forwardly of the reflector, wherein the second distance is greater than the first distance.

9. The base station antenna of claim 4, wherein the first array of radiating elements is configured to form a first antenna beam having a −45° polarization and a second antenna beam having a +45° polarization that each provide coverage to a predefined sector, and wherein the parasitic assembly is configured to alter horizontal components of portions of the first and second antenna beams that are within the sector at least twice as much as respective vertical components of portions of the first and second antenna beam that are within the sector.

10. The base station antenna of claim 4, wherein the parasitic assembly is capacitively coupled to the reflector.

11. The base station antenna of claim 4, wherein the horizontal component shaping element extends substantially parallel to the reflector.

12. A base station antenna, comprising:

a reflector that defines a substantially vertical plane;

a plurality of cross-polarized radiating elements that form a first array of radiating elements, the cross-polarized radiating elements mounted to extend forwardly from the reflector, and each cross-polarized radiating element including a −45° dipole radiator and a +45° dipole radiator;

a parasitic assembly mounted to extend forwardly from the reflector, the parasitic assembly including a base that is mounted on the reflector, a horizontal component shaping element, and a forwardly projecting member that projects forwardly from the base that is coupled between the base and the horizontal component shaping element, wherein the horizontal component shaping element is slanted between 0° and 45° with respect to the substantially vertical plane defined by the reflector, and wherein the parasitic assembly is mounted directly adjacent the first array of radiating elements and is between the first array of radiating elements and a transverse edge of the reflector.

13. The base station antenna of claim 12, wherein the horizontal component shaping element is slanted between 0° and 20° with respect to the substantially vertical plane defined by the reflector.

14. The base station antenna of claim 13, wherein the parasitic assembly comprises one of a plurality of parasitic assemblies, and the parasitic assemblies are mounted between the first array of radiating elements and the transverse edge of the reflector.

15. The base station antenna of claim 12 wherein the horizontal component shaping element extends substantially parallel to the reflector.

16. The base station antenna of claim 12, wherein the horizontal component shaping element includes at least one vertically-extending slot.

17. The base station antenna of claim 12, wherein the first array of radiating elements is configured to form a first antenna beam having a −45° polarization and a second antenna beam having a +45° polarization that each provide coverage to a predefined sector, and wherein the parasitic assembly is configured to alter horizontal components of portions of the first and second antenna beams that are within the sector at least twice as much as respective vertical components of portions of the first and second antenna beam that are within the sector.

18. A base station antenna, comprising:

a reflector that defines a substantially vertical plane;

a plurality of cross-polarized radiating elements that form a first array of radiating elements, the cross-polarized radiating elements mounted to extend forwardly from the reflector, and each cross-polarized radiating element including a −45° dipole radiator and a +45° dipole radiator;

a first parasitic assembly mounted forwardly from the reflector on a first side of the first array of radiating elements and a second parasitic assembly mounted forwardly from the reflector on a second side of the first array of radiating elements, the first and second parasitic assemblies each including a base that is mounted on the reflector, a horizontal component shaping element that extends substantially parallel to the reflector, and a forwardly projecting member that projects forwardly from the base that is coupled between the base and the horizontal component shaping element, wherein the first array of radiating elements is configured to form a first antenna beam having a −45° polarization and a second antenna beam having a +45° polarization that each provide coverage to a predefined sector, and wherein the first parasitic assembly is configured to alter horizontal components of portions of the first and second antenna beams that are within the sector at least twice as much as respective vertical components of portions of the first and second antenna beam that are within the sector.

19. The base station antenna of claim 18, wherein the first array of radiating elements comprises a column of radiating elements that extend along a first axis, and the first parasitic assembly is a first of a plurality of parasitic assemblies that comprise a column of parasitic assemblies that extends along a second axis that is substantially parallel to the first axis.

20. The base station antenna of claim 18, wherein the horizontal component shaping element is slanted less than 20° from the substantially vertical plane defined by the reflector.

21. The base station antenna of claim 18, wherein an extent to which the forwardly projecting member of the first parasitic assembly projects forwardly is selected so that the horizontal component shaping element of the first parasitic assembly will primarily alter a cross-polarization discrimination performance of the first array of radiating elements in a selected sub-band of an operating frequency range of the first array of radiating elements.

22. The base station antenna of claim 18, wherein the first parasitic assembly is capacitively coupled to the reflector, and the first parasitic assembly comprises a monolithic sheet metal assembly.

* * * * *